US008122519B2

(12) United States Patent
Schmelzer et al.

(10) Patent No.: US 8,122,519 B2
(45) Date of Patent: Feb. 28, 2012

(54) SYSTEM AND METHOD FOR SECURING ACCESSORIES TO WEARABLE ITEMS

(75) Inventors: Richard Schmelzer, Boulder, CO (US); Sheri Schmelzer, Boulder, CO (US)

(73) Assignee: Jibbitz, LLC, Niwot, CO (US)

( * ) Notice: Subject to any disclaimer, the term of this patent is extended or adjusted under 35 U.S.C. 154(b) by 1246 days.

(21) Appl. No.: 11/737,649

(22) Filed: Apr. 19, 2007

(65) Prior Publication Data

US 2008/0060110 A1 Mar. 13, 2008

Related U.S. Application Data

(63) Continuation-in-part of application No. 11/408,130, filed on Apr. 20, 2006, now Pat. No. 7,698,836, said application No. 11/737,649 is a continuation-in-part of application No. PCT/US2006/026508, filed on Jul. 7, 2006.

(60) Provisional application No. 60/697,326, filed on Jul. 7, 2005, provisional application No. 60/704,645, filed on Aug. 2, 2005, provisional application No. 60/737,115, filed on Nov. 16, 2005, provisional application No. 60/793,319, filed on Apr. 19, 2006, provisional application No. 60/796,815, filed on May 2, 2006.

(51) Int. Cl.
*A41D 20/00* (2006.01)

(52) U.S. Cl. ..... 2/170; 2/1; 2/69; 63/3; 63/23

(58) Field of Classification Search ..... 2/1, 917, 2/265, 170, 245, 244, 160, 162, 168, 338, 2/311, 321, 322, 339; 63/3, 5.1, 23
See application file for complete search history.

(56) References Cited

U.S. PATENT DOCUMENTS

| | | | | | |
|---|---|---|---|---|---|
| 49,305 | A | * | 8/1865 | Ruggles | 24/108 |
| 326,992 | A | * | 9/1885 | Kuhn | 24/109 |
| 488,090 | A | * | 12/1892 | Rhage | 24/625 |
| 1,410,916 | A | * | 3/1922 | Hendrix | 24/114.05 |
| 1,463,531 | A | | 7/1923 | Kennedy | |
| 1,479,150 | A | * | 1/1924 | Mellus | 2/314 |
| 1,514,706 | A | | 11/1924 | Kennedy | |
| 1,583,274 | A | | 5/1926 | Bostock | |
| 1,711,031 | A | * | 4/1929 | Richards | 24/64 |
| 1,725,509 | A | | 8/1929 | Esposito et al. | |
| 1,963,004 | A | * | 6/1934 | Tucker | 2/127 |
| 2,180,726 | A | * | 11/1939 | Bradley | 63/36 |
| 2,461,799 | A | | 2/1949 | Armstrong | |
| 2,538,396 | A | * | 1/1951 | Sutin | 24/108 |

(Continued)

OTHER PUBLICATIONS

U.S. Appl. No. 29/258,101, filed Apr. 17, 2006, Shoe Accessory.

(Continued)

*Primary Examiner* — Katherine Moran
*Assistant Examiner* — Richale Quinn
(74) *Attorney, Agent, or Firm* — Faegre Baker Daniels LLP

(57) ABSTRACT

A system and method for securing accessories to shoes and other wearable items is described. One illustrative embodiment is a system for attaching a decorative accessory to a wearable item, the system comprising a shaft having first and second ends; a first shoulder secured to the first end of the shaft, the first shoulder being configured for insertion through an expandable hole in the wearable item and configured to engage an inner surface of the wearable item; a second shoulder secured to the second end of the shaft, the second shoulder being configured to engage the wearable item; and a third shoulder adjacent to the second shoulder, the third shoulder comprising the decorative accessory.

29 Claims, 29 Drawing Sheets

U.S. PATENT DOCUMENTS

| | | | | | |
|---|---|---|---|---|---|
| 2,748,517 | A | * | 6/1956 | Berkis | 40/586 |
| 2,887,795 | A | * | 5/1959 | Taicher | 36/58.5 |
| 2,888,767 | A | | 6/1959 | Pinkus | |
| 3,070,907 | A | | 1/1963 | Rocco | |
| 3,210,820 | A | * | 10/1965 | Humiston | 24/704.1 |
| 3,438,063 | A | | 4/1969 | Loston | |
| D214,155 | S | | 5/1969 | Aigner | |
| 3,551,963 | A | * | 1/1971 | Mosher, Jr. et al. | 24/618 |
| 3,601,909 | A | * | 8/1971 | Amendola | 36/44 |
| 3,699,617 | A | | 10/1972 | Hofmeister | |
| 3,849,839 | A | | 11/1974 | Zimber | |
| 4,077,237 | A | * | 3/1978 | Loper | 63/31 |
| 4,457,050 | A | * | 7/1984 | Kanzaka | 24/108 |
| 4,507,344 | A | * | 3/1985 | Baughman | 428/99 |
| 4,597,198 | A | | 7/1986 | Schweitzer | |
| 4,712,319 | A | * | 12/1987 | Goria | 36/137 |
| 4,837,960 | A | | 6/1989 | Skaja | |
| 4,845,865 | A | | 7/1989 | Chang et al. | |
| 4,847,917 | A | * | 7/1989 | Strongwater | 2/160 |
| 4,936,699 | A | * | 6/1990 | Yoshida | 401/48 |
| 5,094,580 | A | * | 3/1992 | Abe | 411/553 |
| 5,136,726 | A | * | 8/1992 | Kellin et al. | 2/244 |
| D342,598 | S | | 12/1993 | Harrington | |
| 5,283,969 | A | * | 2/1994 | Weiss | 40/633 |
| D344,624 | S | * | 3/1994 | Schnel et al. | D2/629 |
| 5,456,032 | A | | 10/1995 | Matsumoto et al. | |
| 5,496,612 | A | | 3/1996 | Ransbottom | |
| 5,586,888 | A | | 12/1996 | Webb | |
| 5,673,499 | A | | 10/1997 | Attilieni | |
| 5,673,501 | A | * | 10/1997 | Mathews | 36/136 |
| 5,746,500 | A | | 5/1998 | Chien | |
| 5,797,281 | A | * | 8/1998 | Fox | 63/12 |
| 5,803,266 | A | * | 9/1998 | Blackwelder | 206/575 |
| 5,852,829 | A | * | 12/1998 | Relaford | 2/338 |
| 5,901,381 | A | * | 5/1999 | Nelson | 2/209.13 |
| 5,979,085 | A | | 11/1999 | Ross et al. | |
| 6,012,203 | A | * | 1/2000 | Baron Pearson | 24/114.9 |
| D426,943 | S | | 6/2000 | Hernandez | |
| D427,420 | S | | 7/2000 | Hernandez | |
| D427,421 | S | | 7/2000 | Hernandez | |
| D428,550 | S | | 7/2000 | Hernandez | |
| D428,687 | S | | 8/2000 | Hernandez | |
| 6,158,096 | A | | 12/2000 | Bar | |
| 6,237,174 | B1 | | 5/2001 | Hutchinson | |
| D457,298 | S | | 5/2002 | Rowland | |
| 6,412,151 | B1 | | 7/2002 | Rowland | |
| 6,412,197 | B1 | | 7/2002 | Krull | |
| 6,513,167 | B1 | * | 2/2003 | Cheng | 2/171 |
| 6,568,044 | B1 | * | 5/2003 | Kidd | 24/104 |
| 6,640,467 | B1 | | 11/2003 | Krull | |
| 6,718,559 | B1 | * | 4/2004 | Davidson | 2/422 |
| 6,802,140 | B2 | | 10/2004 | Aslanides | |
| 7,178,364 | B2 | * | 2/2007 | Shapiro et al. | 63/3 |
| 7,698,836 | B2 | * | 4/2010 | Schmelzer et al. | 36/136 |
| 2007/0006502 | A1 | | 1/2007 | Schmelzer et al. | |
| 2007/0084019 | A1 | * | 4/2007 | Wilcox et al. | 24/3.1 |

OTHER PUBLICATIONS

U.S. Appl. No. 29/258,102, filed Apr. 17, 2006, Shoe Accessory.

U.S. Appl. No. 29/258,148, filed Apr. 17, 2006, Shoe Accessory.

Canadian Intellectual Property Office, Examination Report for Application No. 2,614,369, dated Nov. 19, 2009.

State Intellectual Property Office of the People's Republic of China, Examination Report for Application No. 200680027245.7, stamped Jan. 23, 2009 (rejecting claims 1-31 of the corresponding Chinese PCT application based on the five references listed at page 2).

Intellectual Property Office of New Zealand, Examination Report for Application No. 564914, dated Sep. 9, 2009.

* cited by examiner

SYSTEM AND METHOD FOR SECURING ACCESSORIES TO WEARABLE ITEMS

CROSS-REFERENCE TO RELATED APPLICATIONS

The present application is a continuation-in-part of U.S. patent application Ser. No. 11/408,130, filed on Apr. 20, 2006 now U.S. Pat. No. 7,698,836, entitled, "System and Method for Securing Accessories to Clothing," which claims the benefit of U.S. Provisional Patent Application No. 60/697,326, filed on Jul. 7, 2005, entitled, "Manufacturing and Marketing Method for Accessorizing Shoes," and which claims the benefit of U.S. Provisional Patent Application No. 60/704,645, filed on Aug. 2, 2005, entitled, "Manufacturing and Marketing Method for Accessorizing Shoes," and which claims the benefit of U.S. Provisional Patent Application No. 60/737,115, filed on Nov. 16, 2005, entitled, "Manufacturing and Marketing Method for Accessorizing Shoes;" and the present application is a continuation-in-part of Patent Cooperation Treaty Application No. PCT/US2006/026508, filed on Jul. 7, 2006, entitled, "System and Method for Securing Accessories to Clothing," which claims the benefit of U.S. Provisional Patent Application No. 60/697,326, filed on Jul. 7, 2005, entitled, "Manufacturing and Marketing Method for Accessorizing Shoes," and which claims the benefit of U.S. Provisional Patent Application No. 60/704,645, filed on Aug. 2, 2005, entitled, "Manufacturing and Marketing Method for Accessorizing Shoes," and which claims the benefit of U.S. Provisional Patent Application No. 60/737,115, filed on Nov. 16, 2005, entitled, "Manufacturing and Marketing Method for Accessorizing Shoes;" and the present application claims the benefit of U.S. Provisional Patent Application No. 60/793,319, filed on Apr. 19, 2006, entitled "Wearable Item With Expandable Holes for Personalization Using Removable Ornaments," and claims the benefit of U.S. Provisional Patent Application No. 60/796,815, filed on May 2, 2006, entitled "Wearable Item With Expandable Holes for Personalization Using Removable Ornaments." Each of the aforementioned applications is incorporated herein by reference for all purposes.

The present application is related to the following commonly owned and assigned applications: U.S. design patent application No. 29/258,101, filed on Apr. 17, 2006, entitled "Shoe Accessory," U.S. design patent application No. 29/258,102, filed on Apr. 17, 2006, entitled "Shoe Accessory," and U.S. design patent application No. 29/258,148, filed on Apr. 17, 2006, entitled "Shoe Accessory." Each of the aforementioned applications is incorporated herein by reference for all purposes.

FIELD

The present invention relates to systems and methods for securing accessories to clothing. In particular, but not by way of limitation, the present invention relates to systems and methods for securing accessories to wearable items with stretchable holes.

BACKGROUND

Clothing manufacturers have recently begun manufacturing articles such as shoes and belts made from a stretchable material (e.g., foam). For example, shoe manufacturers have recently begun manufacturing molded shoes that include expandable holes in the upper portion of the shoe. These shoes are generally formed of a foam material with an outer protective layer. CROCS™, located in Niwot, Colo., is one manufacturer of these types of shoes. FIG. 1 illustrates a typical molded shoe 100 with expandable holes 105 in the upper 110.

Accessorizing these molded shoes has presented a significant challenge because of the proximity of the expandable holes 105 in the upper 110 to the wearer's foot. Moreover, these molded shoes are often used for outside activities, so durability of any accessory is important. In addition, children's and adults' models of these molded shoes may have holes of different sizes, and the upper portions may be of different thicknesses. These differences make it difficult to design accessories that fit all types of shoes. The same challenges regarding different hole sizes and thicknesses of material apply to other articles of clothing such as belts or hats.

SUMMARY

Illustrative embodiments of the present invention shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

Embodiments of the present invention may include a system and method for securing accessories to wearable items. One illustrative embodiment is a system for attaching a decorative accessory to a shoe, the system comprising a shaft having first and second ends; a first shoulder secured to the first end of the shaft, the first shoulder being configured for insertion through an expandable hole in an upper portion of the shoe and configured to engage an inner surface of the upper portion of the shoe; a second shoulder secured to the second end of the shaft, the second shoulder being configured to engage the shoe; and a third shoulder adjacent to the second shoulder, the third shoulder comprising the decorative accessory.

Another illustrative embodiment is a system for securing a decorative accessory to a shoe, the system comprising a shoe having an upper portion, the upper portion having an inner surface, an outer surface, and at least one stretchable hole; a shaft having first and second ends; a first shoulder secured to the first end of the shaft, the first shoulder being configured for insertion into the at least one stretchable hole in the upper portion of the shoe and to engage the inner surface of the upper portion of the shoe; a second shoulder secured to the second end of the shaft, the second shoulder being configured to engage the shoe; and a third shoulder adjacent to the second shoulder, the third shoulder comprising the decorative accessory. These and other embodiments are described in more detail herein.

BRIEF DESCRIPTION OF THE DRAWINGS

Embodiments of the present invention are described by reference to the following Detailed Description and to the appended claims when taken in conjunction with the accompanying Drawings wherein:

DETAILED DESCRIPTION

Figure 1:
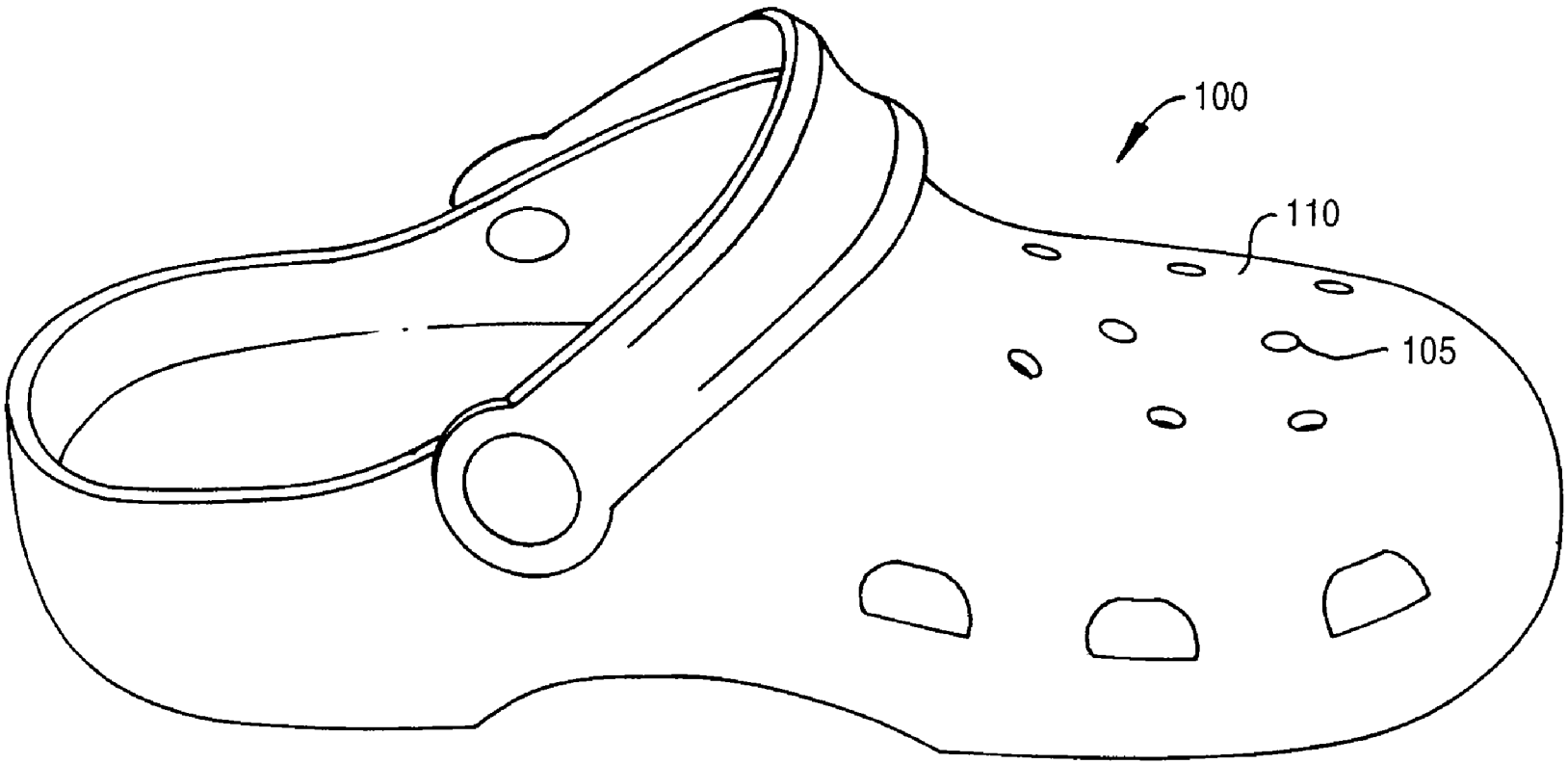
FIG. 1 illustrates a molded shoe with holes in the upper.
Figure 2A:
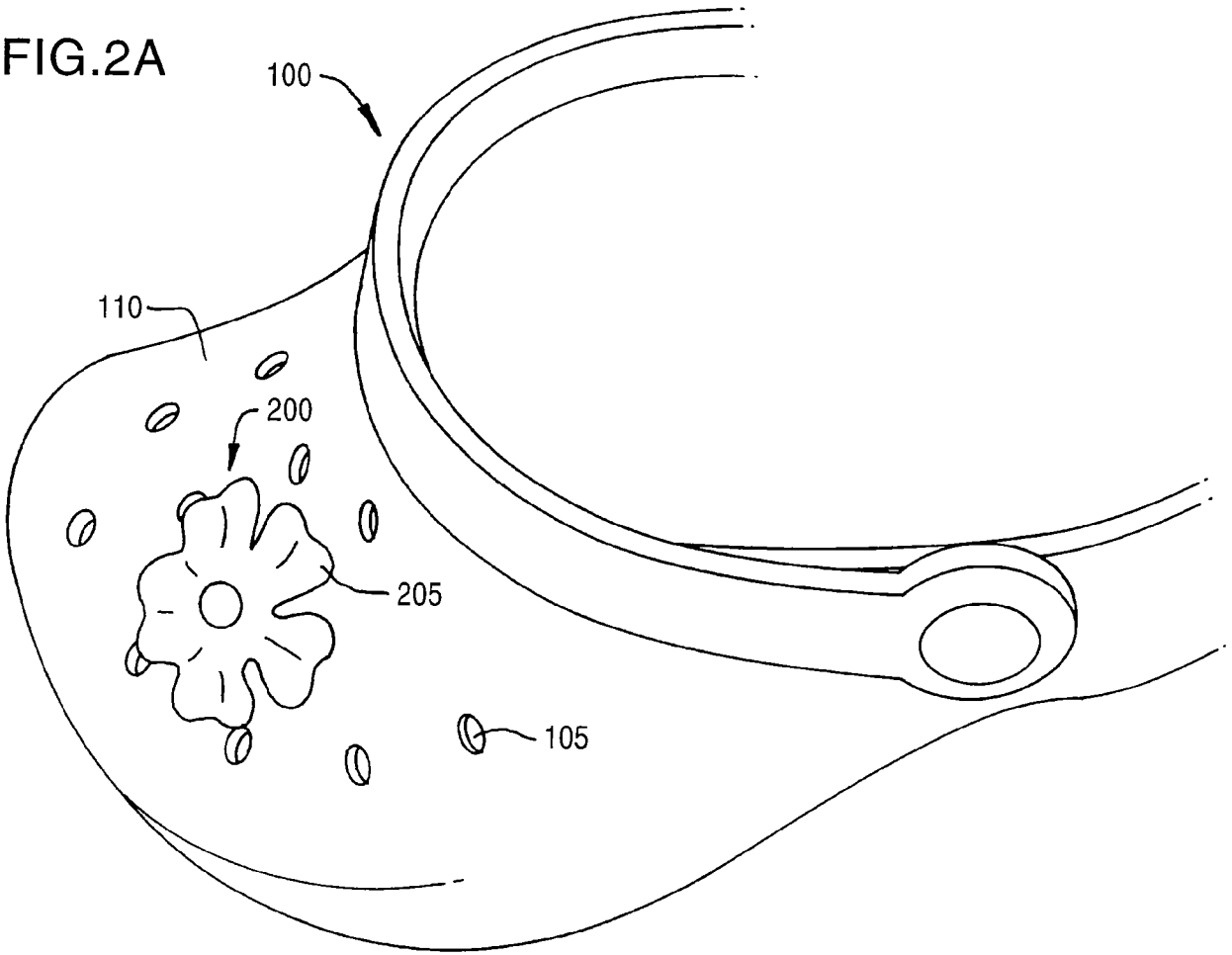
FIG. 2A illustrates a molded shoe with an accessory installed in one of the upper holes, in accordance with an illustrative embodiment of the invention.

Referring now to the drawings, where like or similar elements are designated with identical reference numerals throughout the several views, and referring in particular to FIG. 2A, it illustrates a system 200 for attaching a decorative accessory 205 to a wearable item in accordance with an illustrative embodiment of the invention. In the illustrative embodiment of FIG. 2A, system 200 attaches decorative accessory 205 to a molded shoe 100 through one of the expandable holes 105. Molded shoe 100 is shown in FIG. 2A for illustrative purposes only. In other embodiments, the shoe may be a type other than a molded shoe. In still other embodiments, system 200 can attach decorative accessory 205 to other articles of clothing or wearable items, including, without limitation, belts, hats, and scarves with stretchable holes for insertion of a securing portion of system 200. For example, a belt or hat may be made of a foam material. A scarf may be knitted from a stretchable material such as yarn and have holes through which a securing portion of system 200 can be inserted.

Figure 2B:
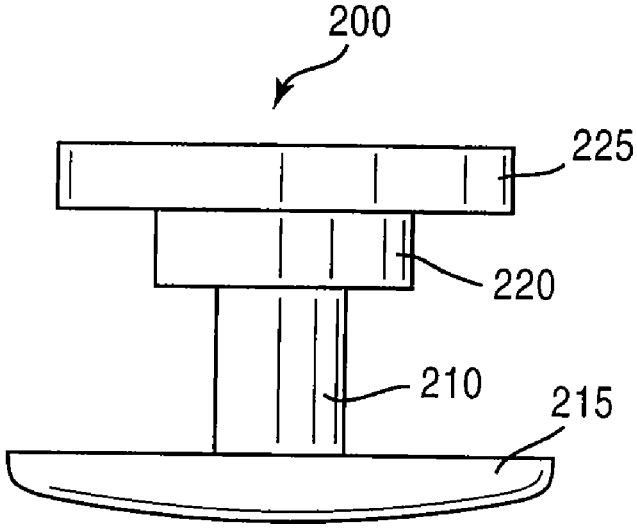
FIG. 2B illustrates a system for attaching a decorative accessory to a wearable item, in accordance with an illustrative embodiment of the invention.

FIG. 2B illustrates a system 200 for attaching a decorative accessory 205 to clothing in accordance with an illustrative embodiment of the invention. FIG. 2B shows a side view of system 200. In this illustrative embodiment, system 200 includes a shaft 210, a first shoulder 215 secured to one end of shaft 210, a second shoulder 220 secured to the opposite end of shaft 210, and a third shoulder 225 that is adjacent to second shoulder 220. For reasons that will become apparent, first shoulder 215 may be termed an "inner shoulder," and second and third shoulders (220 and 225) may be termed "outer shoulders."

First shoulder 215 is configured for insertion through an expandable hole in a wearable item (e.g., an expandable hole 105 in molded shoe 100). Since first shoulder 215 is larger than the expandable hole when the expandable hole is in its unexpanded state, first shoulder secures system 200 to the wearable item. First shoulder 215 engages the inner surface of the wearable item material (e.g., the inner surface of molded shoe 100). Since, when attached to molded shoe 100, first shoulder 215 is close to the wearer's foot, it is advantageous for first shoulder 215 to be a low-profile shoulder for greater comfort. In embodiments in which first shoulder 215 is removably secured to shaft 210, shaft 210 may be inserted into expandable hole 105, and first shoulder 215 may be placed on the inside of the wearable item and secured to shaft 210.

Second shoulder 220 engages the wearable item (e.g., molded shoe 100), but how it engages the wearable item varies depending on the embodiment, as will be explained more fully in connection with FIGS. 2C and 2D.

In the embodiment shown in FIG. 2B, third shoulder 225 is flush mounted to second shoulder 220. Flush mounting can be accomplished in a variety of ways. In one embodiment, third shoulder 225 is glued to second shoulder 220. In some embodiments, decorative accessory 205 is separate from third shoulder 225 and is attached to third shoulder 225 by a suitable chemical (e.g., glue) or mechanical fastener. In other embodiments, decorative accessory 205 is fully or partially integrated (e.g., molded) with third shoulder 225. In some embodiments, third shoulder 225 and decorative accessory 205 are one and the same. For example, decorative accessory may be a design such as a "smiley face" that is stamped or embossed, optionally in relief, on the exposed surface of third shoulder 225.

Shaft 210, first shoulder 215, second shoulder 220, and third shoulder 225 may vary in their lateral cross-sectional shape, depending on the embodiment. For example, in embodiments in which third shoulder 225 and decorative accessory 205 are one and the same, third shoulder 225 may be in the shape of a frog, butterfly, heart, or any other decorative shape. In one embodiment, shaft 210 and second shoulder 220 are cylindrical in shape, and first shoulder 215 is circular and concave in shape, the bottom of the "dish" facing away from the inner surface of the wearable item. FIGS. 2E and 2F are bottom views of first shoulder 215 illustrating alternative lateral cross-sectional shapes, in accordance with other illustrative embodiments of the invention. In FIGS. 2E and 2F, second shoulder 220 and third shoulder 225 have been omitted for clarity.

In some embodiments, shaft 210, first shoulder 215, second shoulder 220, and third shoulder 225 (which may include decorative accessory 205) are all integrally formed as a single piece (e.g., they are molded from single piece of plastic). In other embodiments, either or both of first shoulder 215 and second shoulder 220 are removably secured to shaft 210. In some embodiments, third shoulder 225 is removably secured to second shoulder 220. In the embodiments having a removably-attached shoulder, the removable shoulder can be attached to shaft 210 by a snap fastener, adjustable barrel nut, bayonet fastener, or other suitable fastener.

Figure 2C:
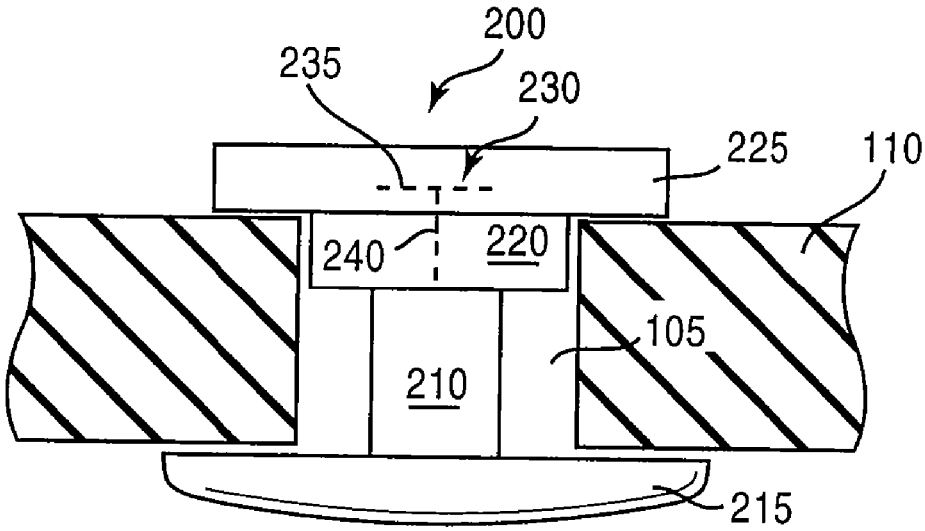
FIG. 2C illustrates a system for attaching a decorative accessory to a wearable item made of a relatively thicker material and having a relatively larger hole, in accordance with another illustrative embodiment of the invention.

FIG. 2C shows system 200 after insertion of first shoulder 215 through an expandable hole in a wearable item, in accordance with another illustrative embodiment of the invention. In this embodiment, second shoulder 220 is configured to fit within expandable hole 105 in its unexpanded state, allowing third shoulder 225 to engage the outer surface of the wearable item (e.g., the outer surface of upper 110 of molded shoe 100). The embodiment shown in FIG. 2C accommodates relatively thicker material and relatively larger-diameter expandable holes 105, such as might be found in an adult-model molded shoe 100. Since second shoulder 220 sits within expandable hole 105 in its unexpanded state, it provides additional lateral stability to system 200.

In the illustrative embodiment shown in FIG. 2C, second shoulder 220 and third shoulder 225 are secured to each other by a pin 230. Third shoulder 225 is molded around a head portion 235 of pin 230, and second shoulder 220 is molded around a needle portion 240 of pin 230 that forms a pop rivet during manufacturing.

Figure 2D:
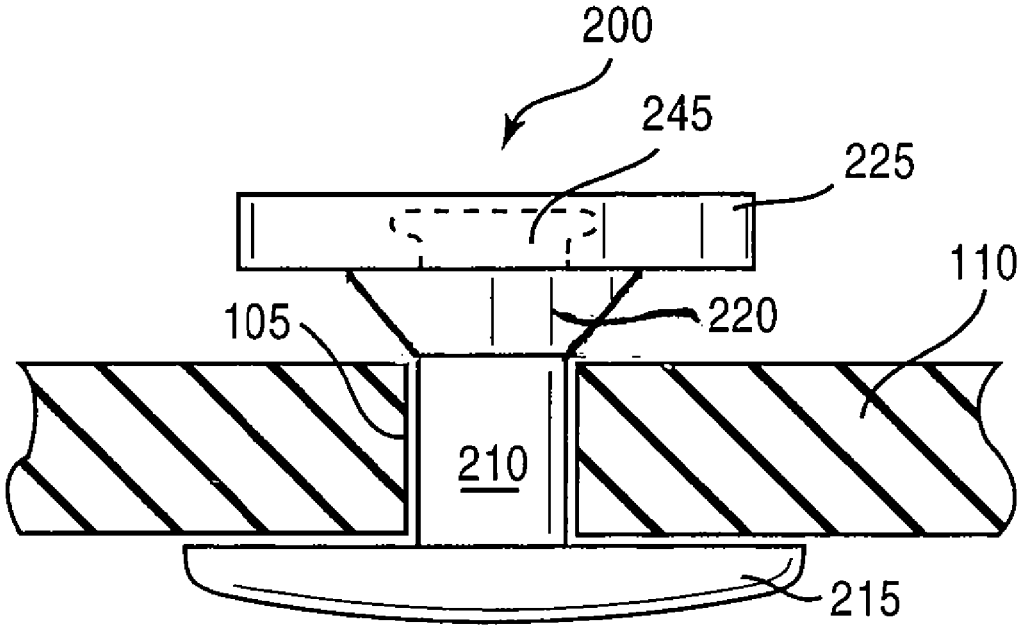
FIG. 2D illustrates a system for attaching a decorative accessory to a wearable item made of a relatively thinner material and having a relatively smaller hole, in accordance with yet another illustrative embodiment of the invention.
Figure 2E:
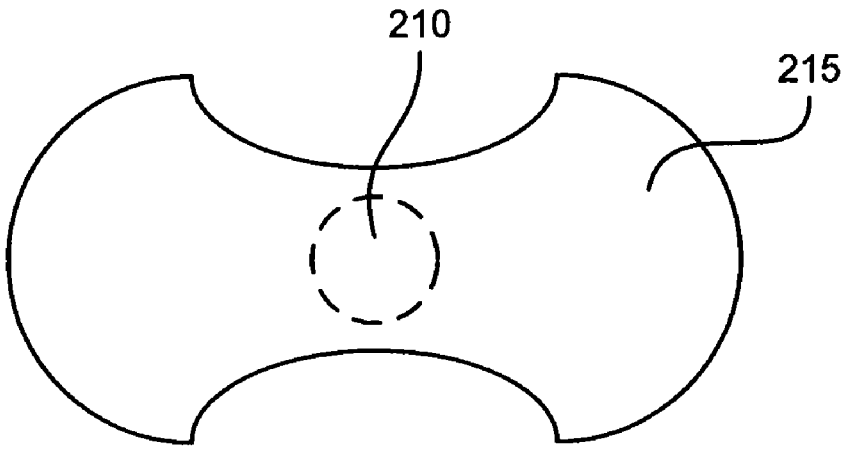
FIG. 2E illustrates the lateral cross-sectional shape of a first shoulder of a system for attaching a decorative accessory to a wearable item, in accordance with an illustrative embodiment of the invention.
Figure 2F:
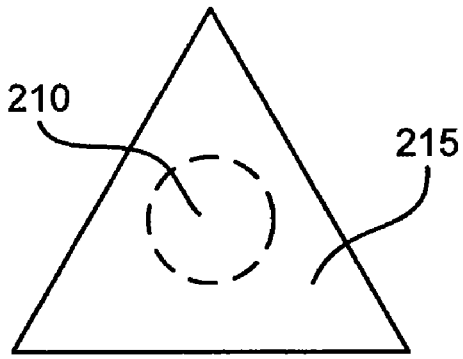
FIG. 2F illustrates the lateral cross-sectional shape of a first shoulder of a system for attaching a decorative accessory to a wearable item, in accordance with another illustrative embodiment of the invention.

FIG. 2D shows system 200 after insertion of first shoulder 215 through an expandable hole in a wearable item, in accordance with yet another illustrative embodiment of the invention. In this embodiment, second shoulder 220 is larger than expandable hole 105 in its unexpanded state. Consequently, second shoulder 220 engages the outer surface the wearable item (e.g., the outer surface of upper 110), acting as a spacer. The embodiment shown in FIG. 2D accommodates relatively thinner material and relatively smaller-diameter expandable holes 105, such as might be found in a child-model molded shoe 100. In the illustrative embodiment shown in FIG. 2D, second shoulder 225 is molded around a fourth shoulder 245 that extends from the top surface of second shoulder 220.

The shoulders of system 200 can be made of any material, including without limitation plastic, metal, and rubber. Additionally, the shoulders can include without limitation an inner rigid portion, such as metal, and a softer outer portion, such as rubber, that provides increased comfort for the wearer. Further, shaft 210 can be made of any material, including plastic, metal, and rubber. The shaft 210 can include a rigid inner portion and a softer outer portion to provide the wearer with increased comfort.

In embodiments other than those illustrated in FIGS. 2B-2D, system 200 may include only two shoulders (e.g., first shoulder 215 and second shoulder 220). In those embodiments, second shoulder 220 is analogous to third shoulder 225 in the embodiments illustrated in FIGS. 2B-2D. For example, decorative accessory 205 may be fully or partially integrated with second shoulder 220 in such two-shoulder designs.

FIGS. 3-15C illustrate variations in the shape and size of the shoulders of a system for attaching a decorative accessory 205 to clothing and variations in how one or more shoulders of the system can be removably attached to shaft 210, in accordance with illustrative embodiments of the invention. In most of the embodiments illustrated in FIGS. 3-15C, only two shoulders are shown. A third shoulder can, of course, be added to those embodiments, if desired.

Figure 3:
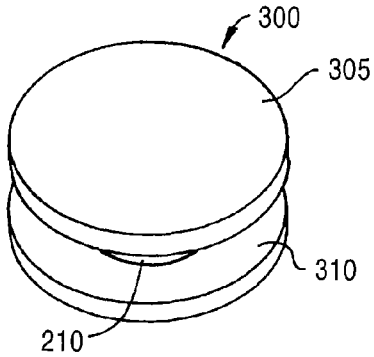
FIG. 3 illustrates an embodiment of a system for attaching a decorative accessory to a wearable item that includes two equally-sized shoulders.

FIG. 3 illustrates a system 300 for securing a decorative accessory 205 to a molded shoe 100 or other wearable item, in accordance with an illustrative embodiment of the invention. This embodiment includes two equally-sized shoulders 305 and 310 at either end of shaft 210. At least one shoulder (305 or 310) may be a low-profile shoulder.

Figure 4:
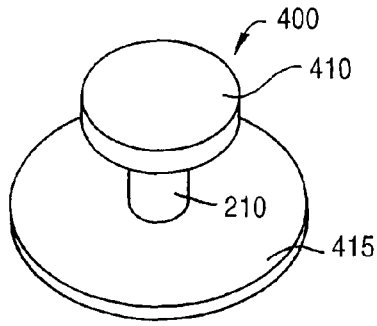
FIG. 4 illustrates another embodiment of a system for attaching a decorative accessory to a wearable item that includes different sized shoulders.

FIG. 4 illustrates a system 400 for securing a decorative accessory 205 to a molded shoe 100 or other wearable item, in accordance with an illustrative embodiment of the invention. In system 400, shoulders 410 and 415 are different in size. In this illustrative embodiment, the larger shoulder 415 is a low-profile shoulder and is positioned on the inside of the article of clothing (e.g., molded shoe 100). The smaller shoulder 410 is configured to engage the outer surface of the wearable item or to fit within an expandable hole in its unexpanded state, as explained above.

Figure 5:
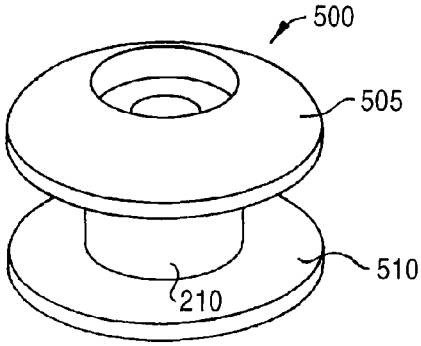
FIG. 5 illustrates another embodiment of a system for attaching a decorative accessory to a wearable item that includes an adjustable barrel nut to accommodate varying material thicknesses.

FIG. 5 illustrates a system 500 for securing a decorative accessory 205 to a molded shoe 100 or other wearable item, in accordance with an illustrative embodiment of the invention. System 500 includes a barrel nut, which may be made of metal or other suitable material. The barrel nut includes two equally-sized shoulders 505 and 510. One of the shoulders is part of the female portion of the barrel nut, and the other shoulder is part of the male portion of the barrel nut. The threaded barrel nut allows system 500 to be adjusted for different thicknesses of material. As illustrated in FIG. 5, one or both shoulders of system 500 may be rounded in shape (see shoulder 505) or other shapes. In FIG. 5, the two portions of the barrel nut are shown screwed together.

Figure 6:
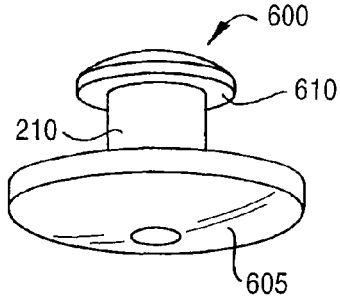
FIG. 6 illustrates another embodiment of a system for attaching a decorative accessory to a wearable item that includes rounded shoulders of different sizes.

FIG. 6 illustrates a system 600 for securing a decorative accessory 205 to a molded shoe 100 or other wearable item, in accordance with an illustrative embodiment of the invention. System 600 includes two unequally-sized shoulders 605 and 610, at least one of which is rounded and at least one of which is a low-profile shoulder.

Figure 7A:
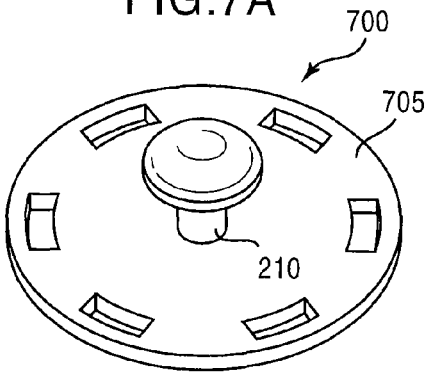
FIGS. 7A and 7B illustrate another embodiment of a system for attaching a decorative accessory to a wearable item that includes male and female portions, respectively, of a button snap.
Figure 7B:
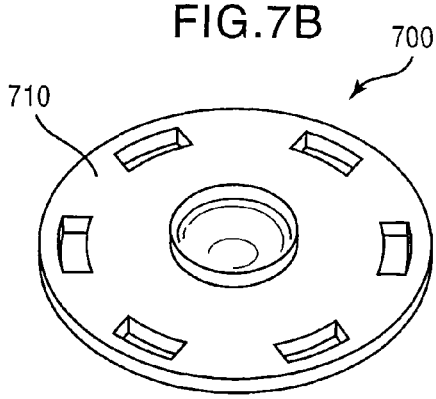

FIGS. 7A and 7B illustrate a system 700 for securing a decorative accessory 205 to a molded shoe 100 or other wearable item, in accordance with an illustrative embodiment of the invention. System 700 includes a male portion 705 of a button snap (FIG. 7A) that includes one shoulder and shaft 210 and a matching female portion 710 of the button snap (FIG. 7B) that includes a second shoulder.

Figure 8A:
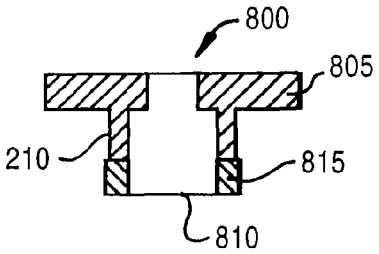
FIGS. 8A-8D illustrate another embodiment of a system for attaching a decorative accessory to a wearable item that includes a locking fastener for which compressible clothing material acts as a spring.

FIGS. 8A-8D are schematics of a system 800 for securing a decorative accessory 205 to a molded shoe 100 or other wearable item, in accordance with an illustrative embodiment of the invention. System 800 includes a locking fastener that uses the compressibility of the wearable item material (e.g., foam) itself as a spring. FIG. 8A illustrates, in cross section, a portion of system 800 that includes fixed shoulder 805 and shaft 210. The fixed shoulder 805 could, as the inner shoulder, include a low-profile shoulder to minimize a wearer's discomfort. Alternatively, the fixed shoulder 805 could, as an outer shoulder, be attached to the decorative accessory 205 or be integrated with decorative accessory 205.

Figure 8B:
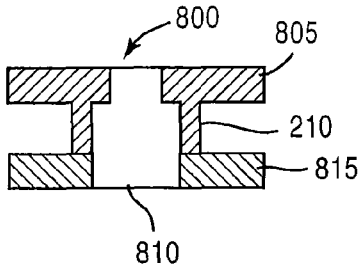

In this embodiment, the end 810 of shaft 210 opposite fixed shoulder 805 includes a rectangular flange 815. Rectangular flange 815 is configured to be inserted through a rectangular cutout in a mating receiver. When rectangular flange 815 is rotated (twisted) 90 degrees while the clothing material is slightly compressed, rectangular flange 815 engages a rectangular depression in the receiver. Releasing the pressure on the clothing material acts as a spring to lock flange 815 it into place and to establish the receiver as a second shoulder. FIG. 8B shows another side view of the portion of system 800 shown in FIG. 8A.

Figure 8C:
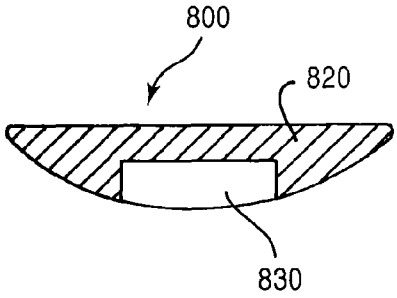
Figure 8D:
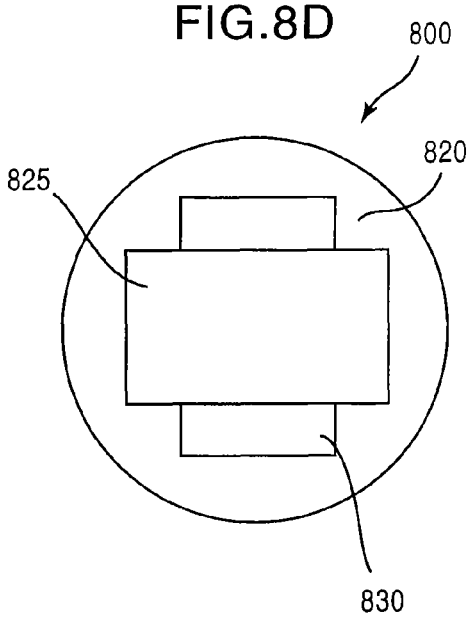

FIG. 8C illustrates, in cross section, a receiver 820 of system 800. The receiver 820 is rounded to present a low-profile to the wearer's foot or other body part. FIG. 8D is a bottom view of receiver 820 that shows rectangular cutout 825 and rectangular depression 830.

Figure 9A:
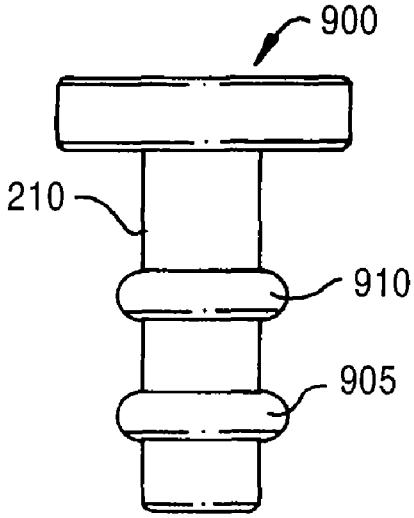
FIGS. 9A-9C illustrate another embodiment of a system for attaching a decorative accessory to a wearable item that includes a shaft having two lip rings and a removable shoulder for variable thickness clothing material.
Figure 9B:
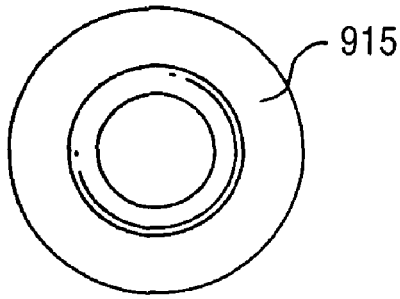
Figure 9C:
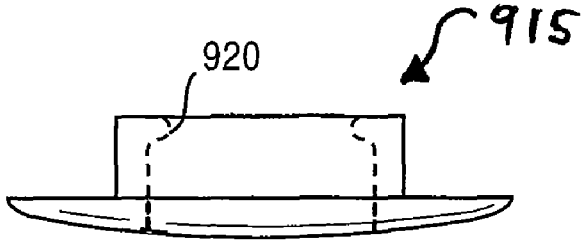

FIGS. 9A-9C illustrate a system 900 for securing a decorative accessory 205 to a molded shoe 100 or other wearable item, in accordance with an illustrative embodiment of the invention. System 900 includes lip rings 905 and 910 on shaft 210 (FIG. 9A) for engaging a removable shoulder 915 (FIGS. 9B and 9C). Removable shoulder 915 can be slid onto shaft 210 and forced past one or both lip rings (905 and/or 910), providing adjustability for different thicknesses of wearable item material. For example, the lower lip 905 can be used to secure system 900 to a thicker adult's molded shoe 100. The upper lip 910 can be used to secure system 900 to a thinner child's molded shoe 100.

FIG. 9C is a side view of removable shoulder 915 illustrating that removable shoulder 915 may have a rounded shape on the bottom and that removable shoulder 915 may include a circumferential ridge 920 (see dashed lines in FIG. 9C indicating hidden lines) along the inside of a hole in its center. Circumferential ridge 920 can be forcefully slid past one or both lip rings (905 and/or 910) to secure removable shoulder 915 in place.

Figure 10A:
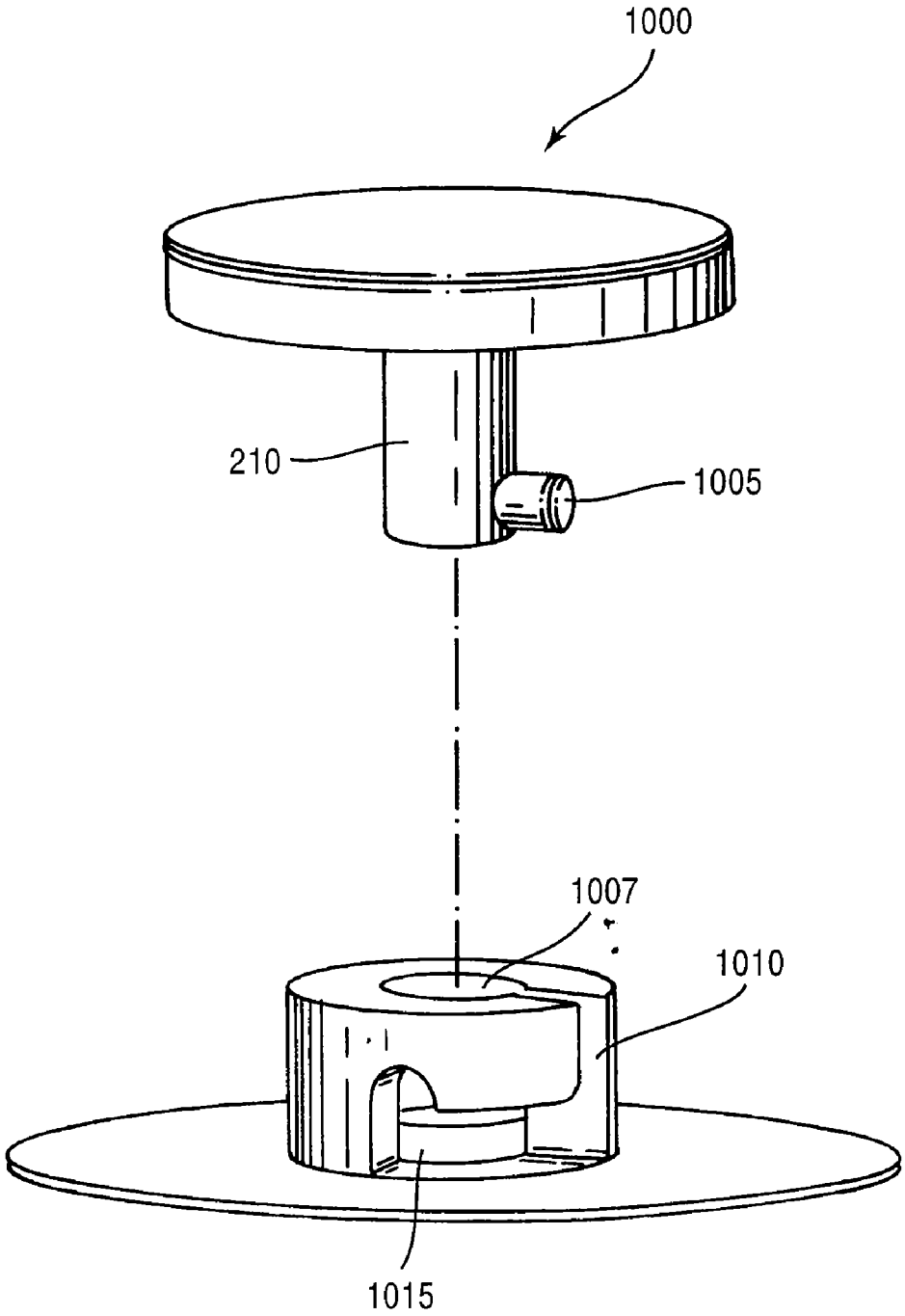
FIGS. 10A and 10B illustrate another embodiment of a system for attaching a decorative accessory to a wearable item that includes a single-tab-and-slot bayonet-type fastener.
Figure 10B:
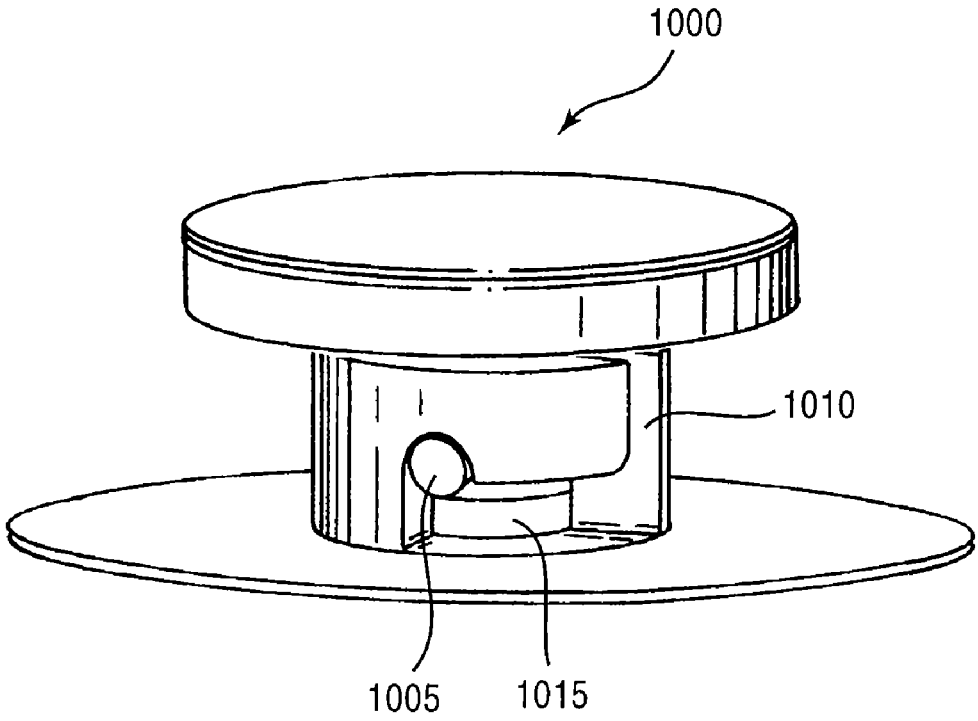

FIGS. 10A and 10B illustrate a system 1000 for securing a decorative accessory 205 to a molded shoe 100 or other wearable item, in accordance with an illustrative embodiment of the invention. Referring to FIG. 10A, system 1000 includes a single-tab-and-slot bayonet-type fastener. Shaft 210 with tab 1005 is inserted into hole 1007 and aligned with slot 1010 through sufficient compression of spring (e.g., piece of foam) 1015. Rotating shaft 210 to bring tab 1005 to the limit of slot 1010 and releasing the compression of spring 1015 locks the fastener into place. FIG. 10B shows system 1000 after the two portions of system 1000 have been fastened together.

Figure 11A:
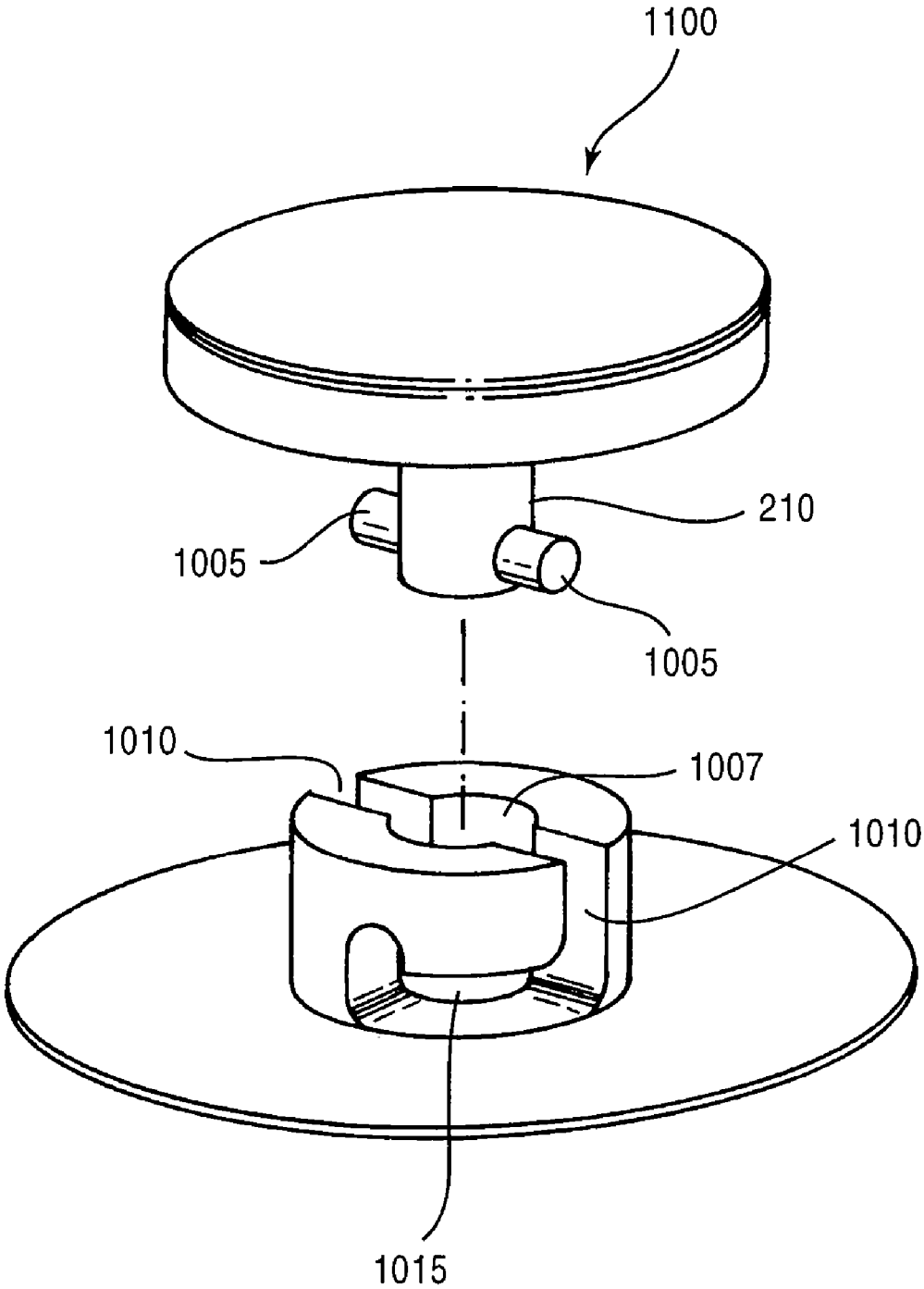
FIGS. 11A and 11B illustrate another embodiment of a system for attaching a decorative accessory to a wearable item that includes a double-tab-and-slot bayonet-type fastener.
Figure 11B:
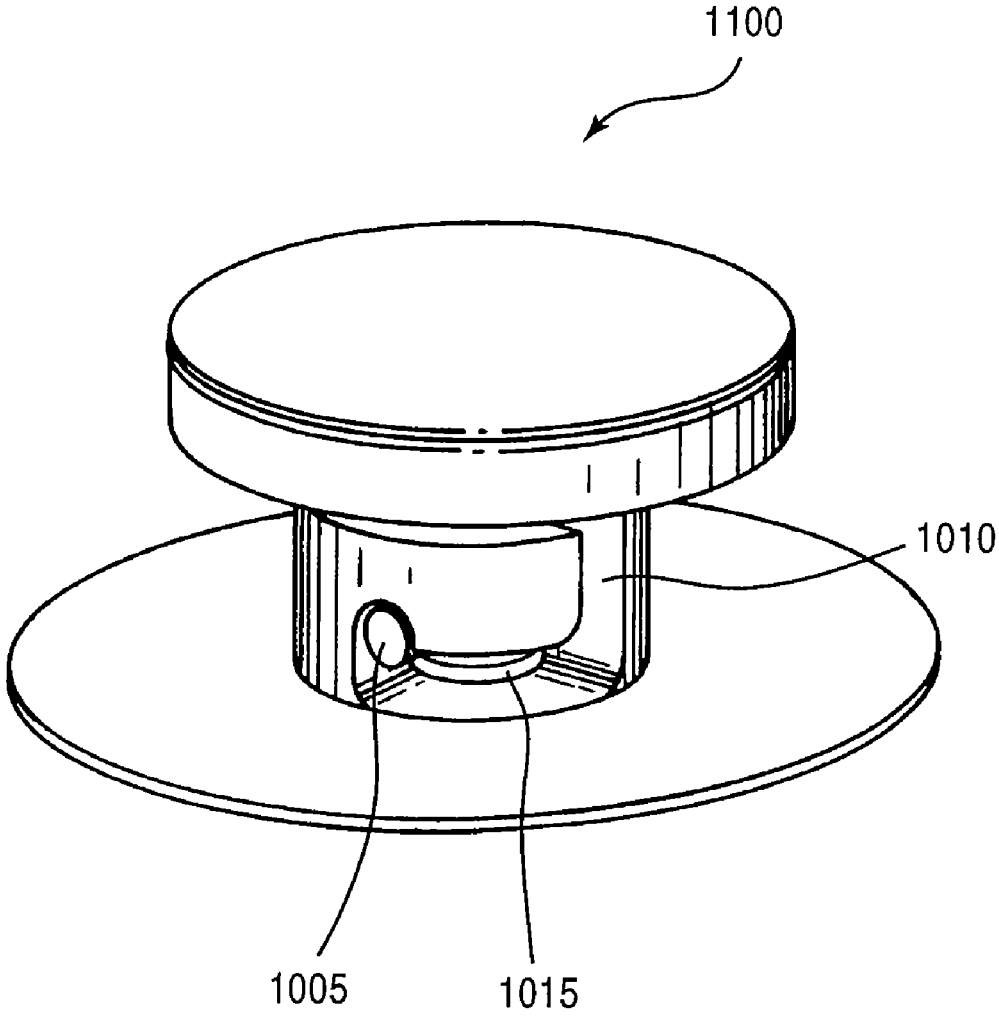

FIGS. 11A and 11B illustrate a system 1100 for securing a decorative accessory 205 to a molded shoe 100 or other wearable item, in accordance with an illustrative embodiment of the invention. Referring to FIG. 11A, system 1100 is similar to system 1000 above, except that system 1100 includes two tabs 1005 and two corresponding slots 1010. FIG. 11B shows system 1100 after the two portions of system 1100 have been fastened together.

Figure 12A:
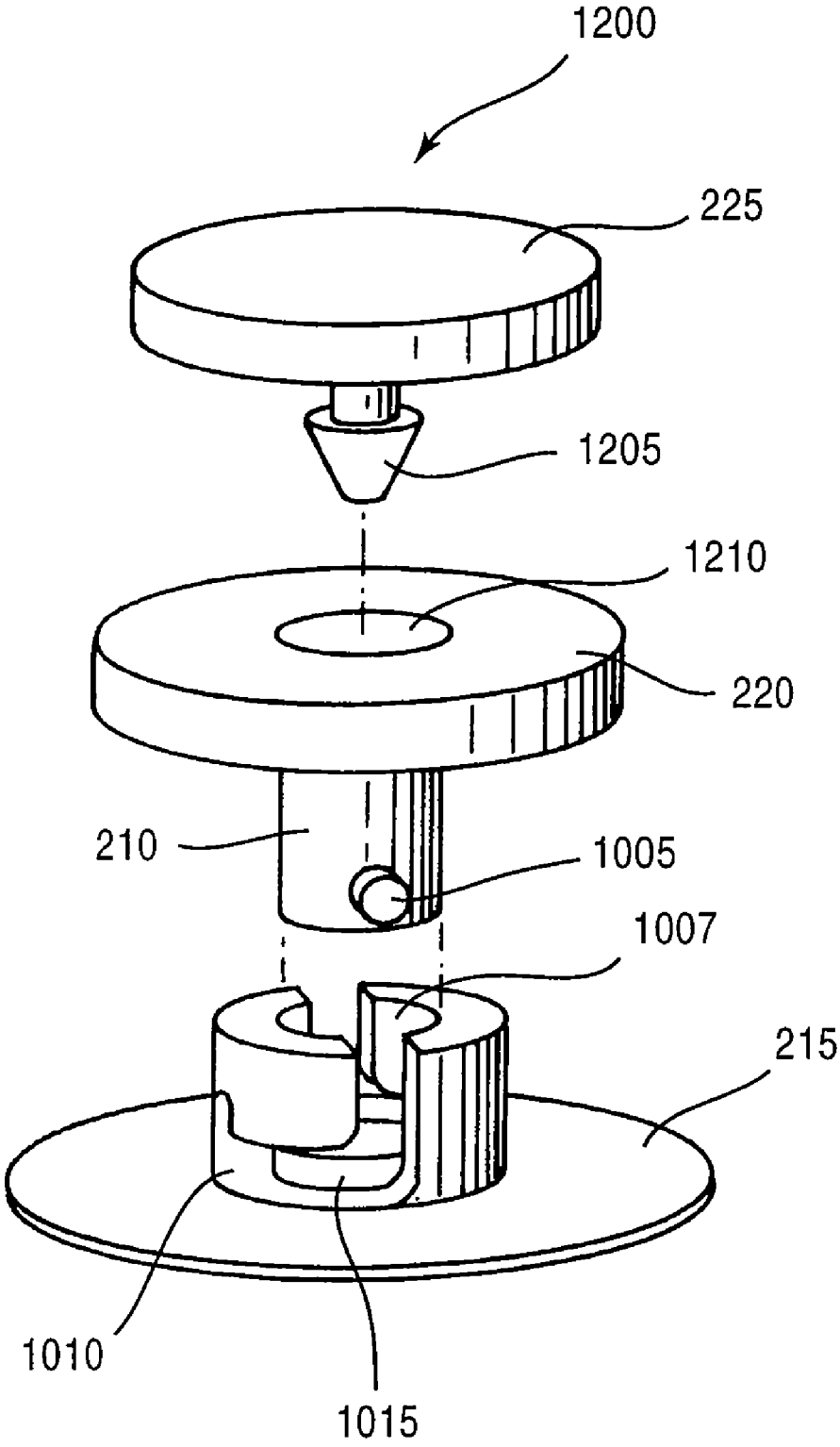
FIGS. 12A and 12B illustrate another embodiment of a system for attaching a decorative accessory to a wearable item that includes a double-tab-and-slot bayonet-type fastener and a shoulder that snaps onto another shoulder.
Figure 12B:
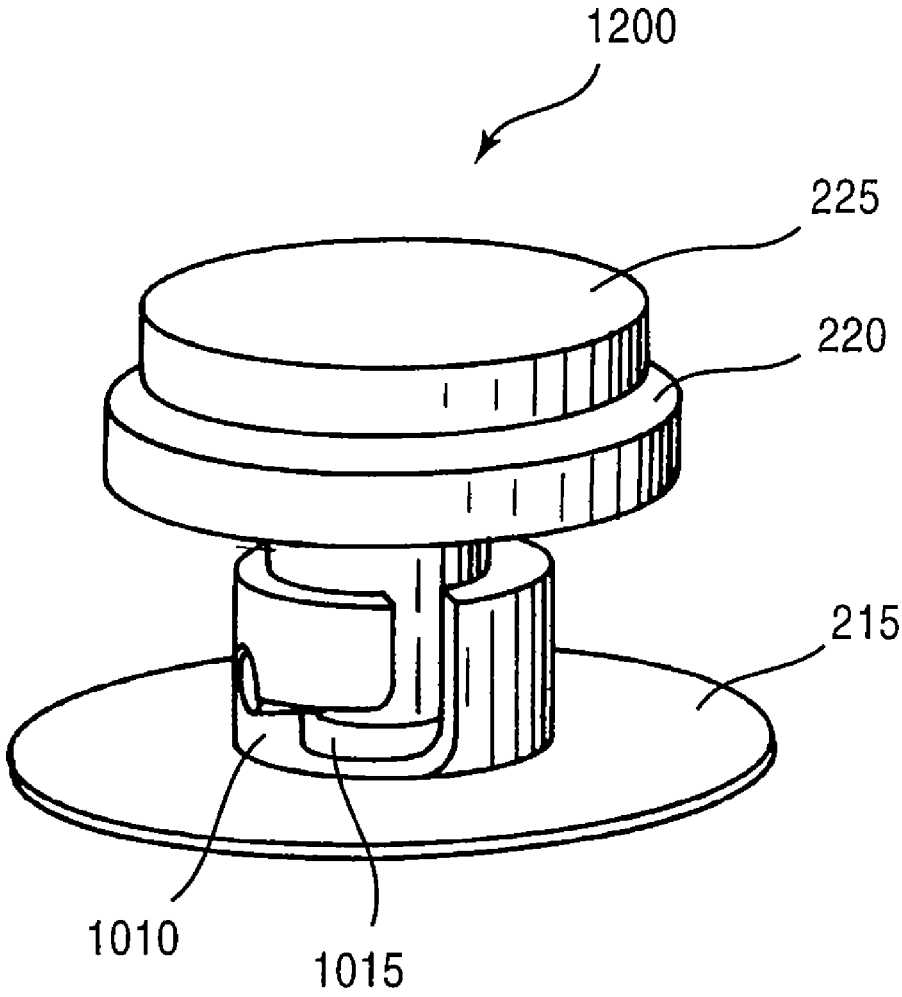

FIGS. 12A and 12B illustrate a system 1200 for securing a decorative accessory 205 to a molded shoe 100 or other wearable item, in accordance with an illustrative embodiment of the invention. Referring to FIG. 12A, system 1200 is similar to system 1100 above, except that third shoulder 225 is attached to second shoulder 220 using a pop-rivet-like fastener that includes tab 1205 on third shoulder 225 and receiver portion 1210 in second shoulder 220. The two portions of the pop-rivet-like fastener can be forcibly engaged to secure third shoulder 225 to second shoulder 220. FIG. 12B shows system 1200 after the three parts of system 1200 have been fastened together.

Figure 13A:
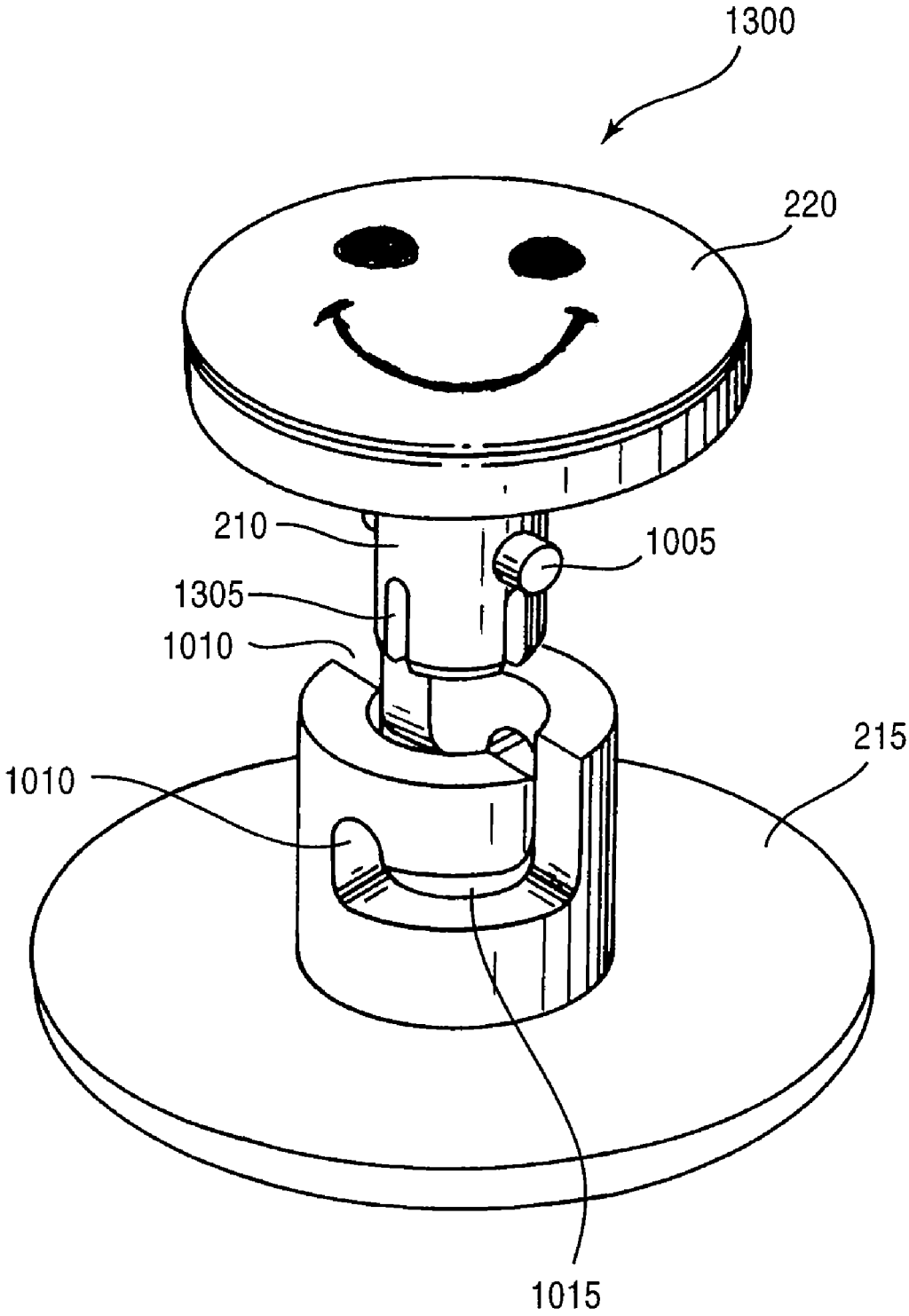
FIGS. 13A-13D illustrate another embodiment of a system for attaching a decorative accessory to a wearable item that includes a double-tab-and-slot bayonet-type fastener and a deformable shaft end.
Figure 13B:
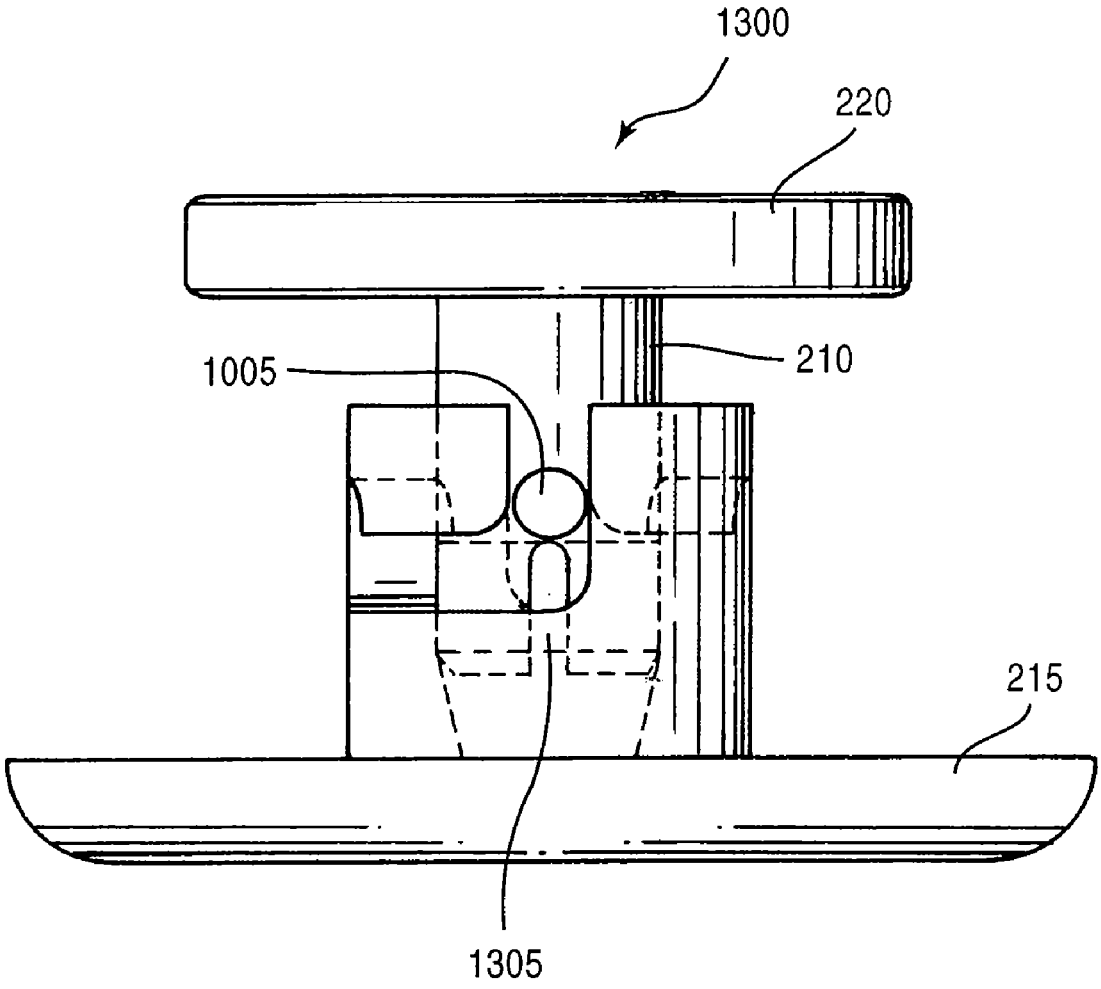
Figure 13C:
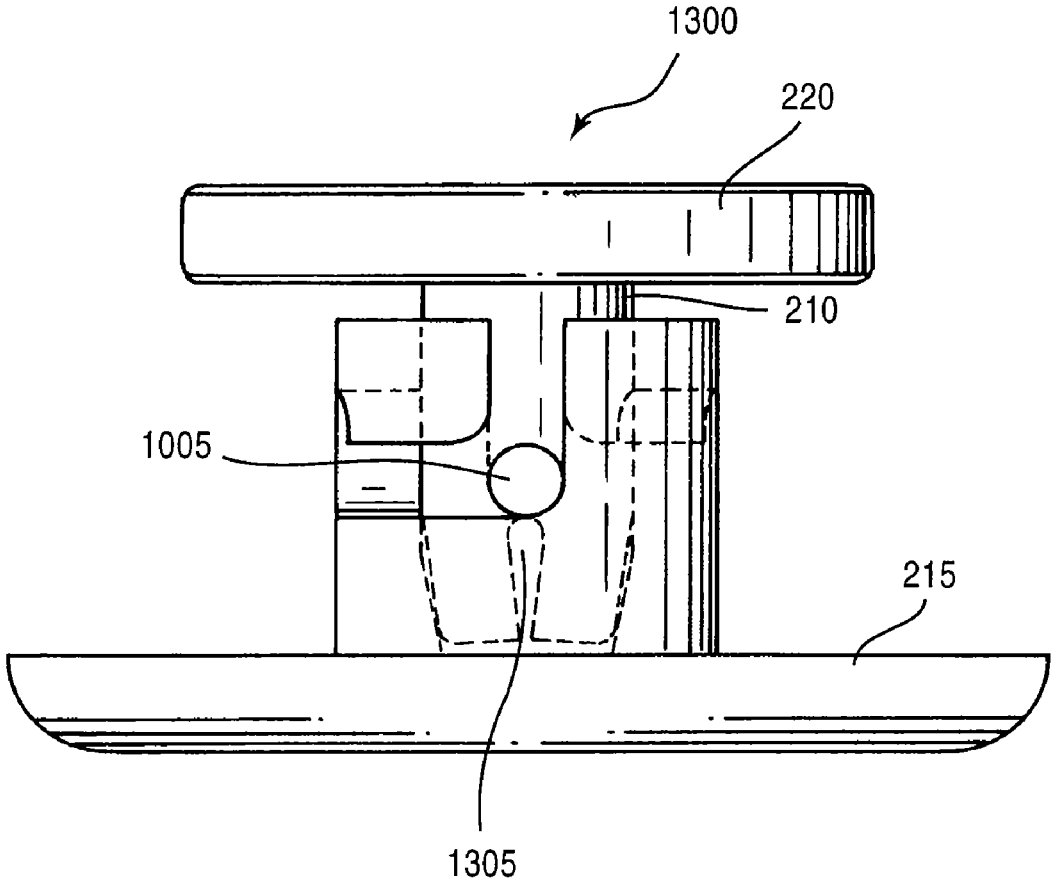
Figure 13D:
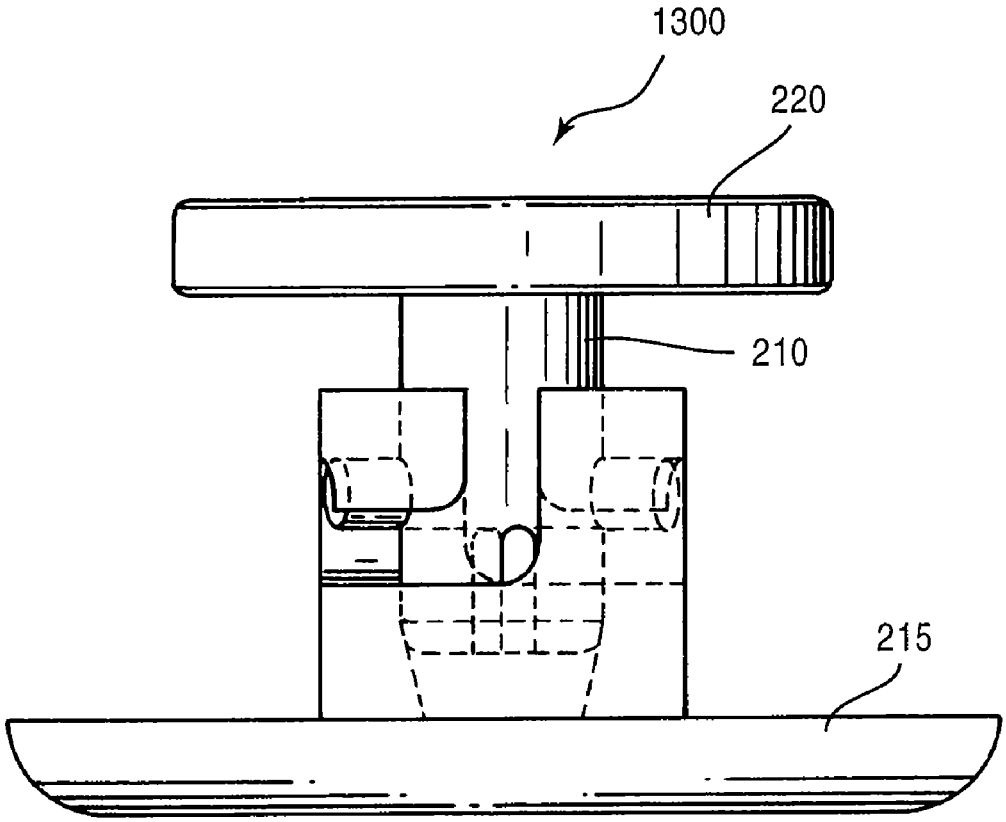

FIGS. 13A-13D illustrate a system 1300 for securing a decorative accessory 205 to a molded shoe 100 or other wearable item, in accordance with an illustrative embodiment of the invention. Referring to FIG. 13A, system 1300 is similar to system 1100 above, except that shaft 210 includes a set of slots 1305 that cause the end of shaft 210 opposite second shoulder 220 to be inwardly bendable when locked into the receiving portion that includes first shoulder 215. FIGS. 13B-13D show additional views of system 1300 when the two portions of system 1300 are fastened together.

Figure 14A:
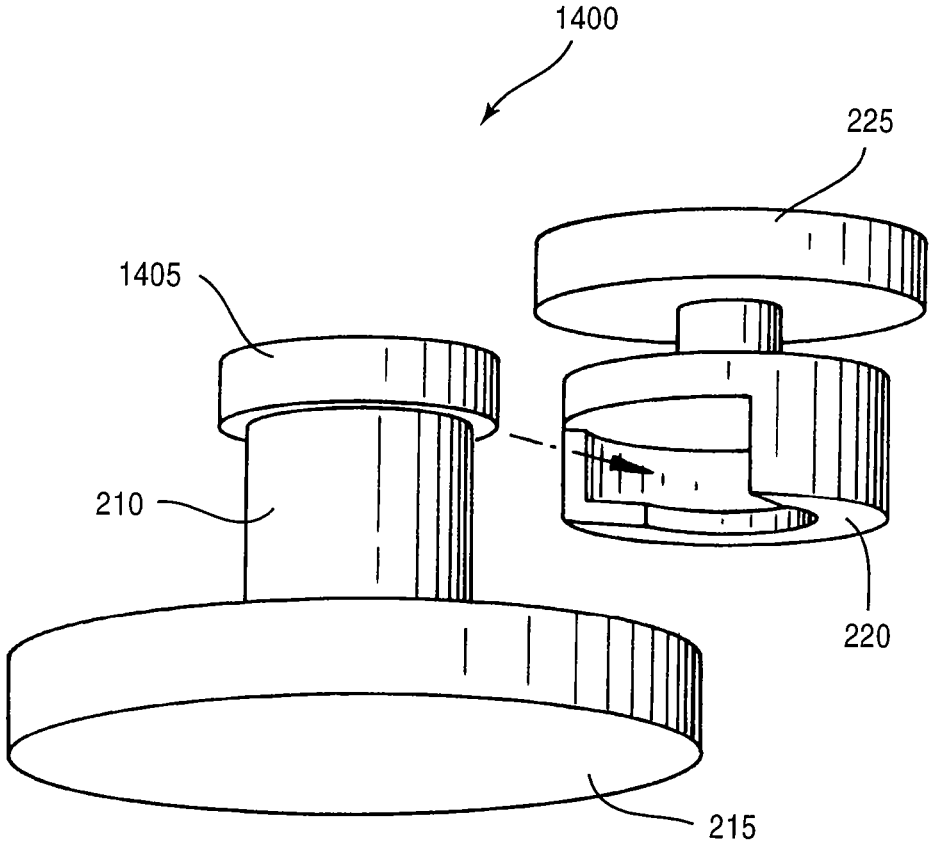
FIGS. 14A and 14B illustrate another embodiment of a system for attaching a decorative accessory to a wearable item that includes a sliding fastener.
Figure 14B:
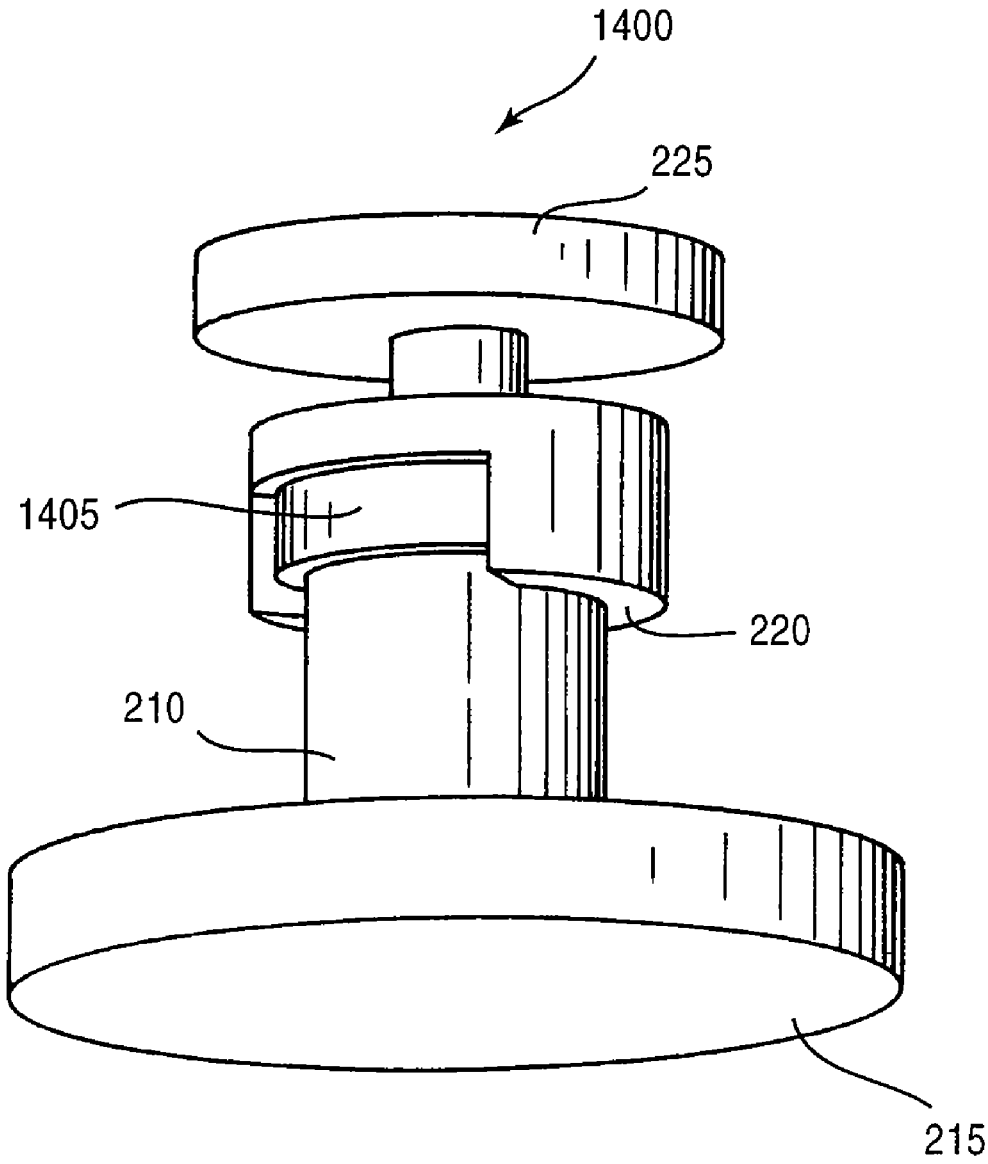

FIGS. 14A and 14B illustrate a system 1400 for securing a decorative accessory 205 to a molded shoe 100 or other wearable item, in accordance with an illustrative embodiment of the invention. Referring to FIG. 14A, system 1400 includes a sliding fastener. Second shoulder 220 is configured to slide onto a rim 1405 around the end of shaft 210 opposite first shoulder 215. FIG. 14B shows system 1400 after the two portions of system 1400 have been fastened together.

Figure 15A:
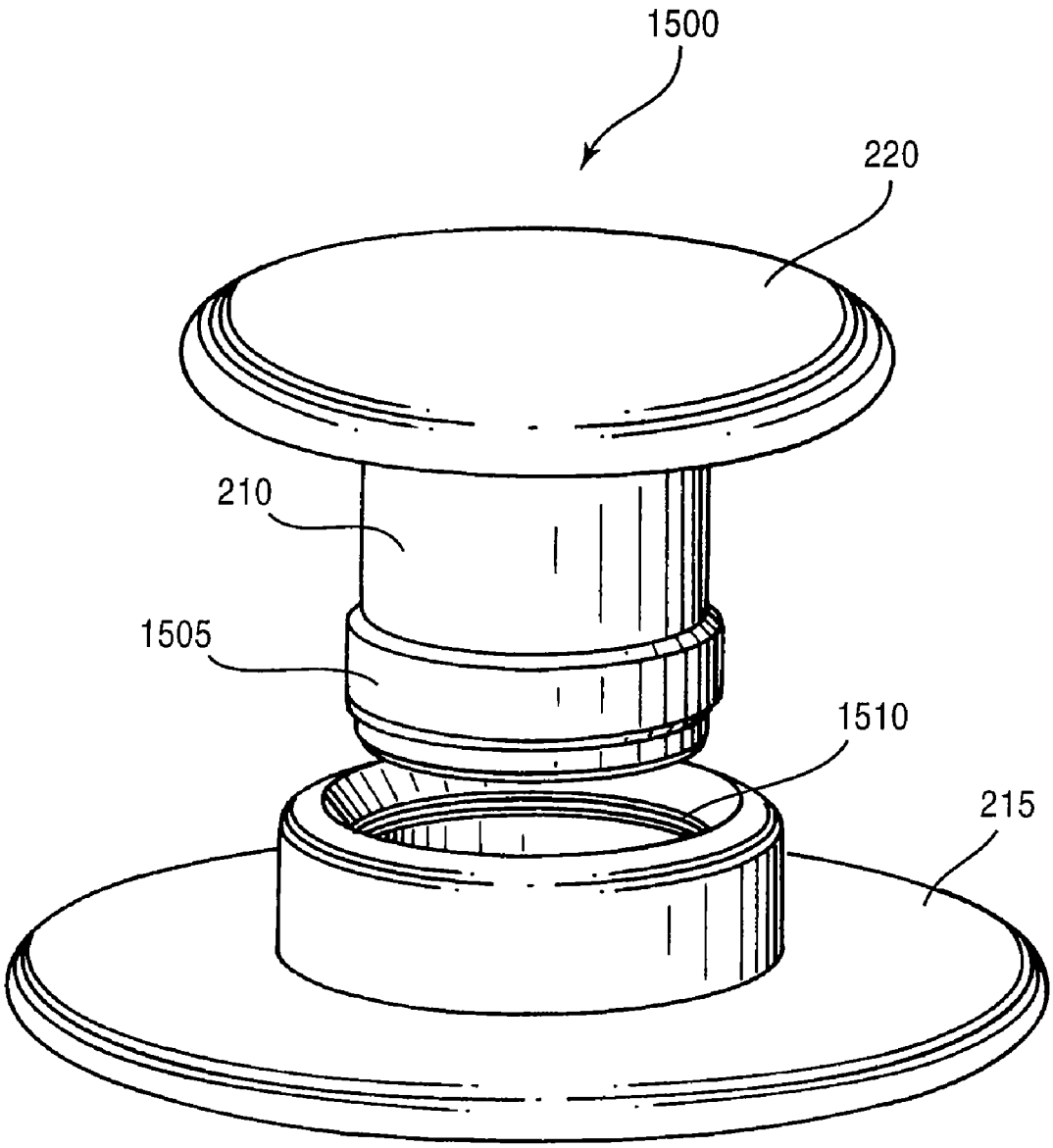
FIGS. 15A-15C illustrate another embodiment of a system for attaching a decorative accessory to a wearable item that includes a snap fastener.
Figure 15B:
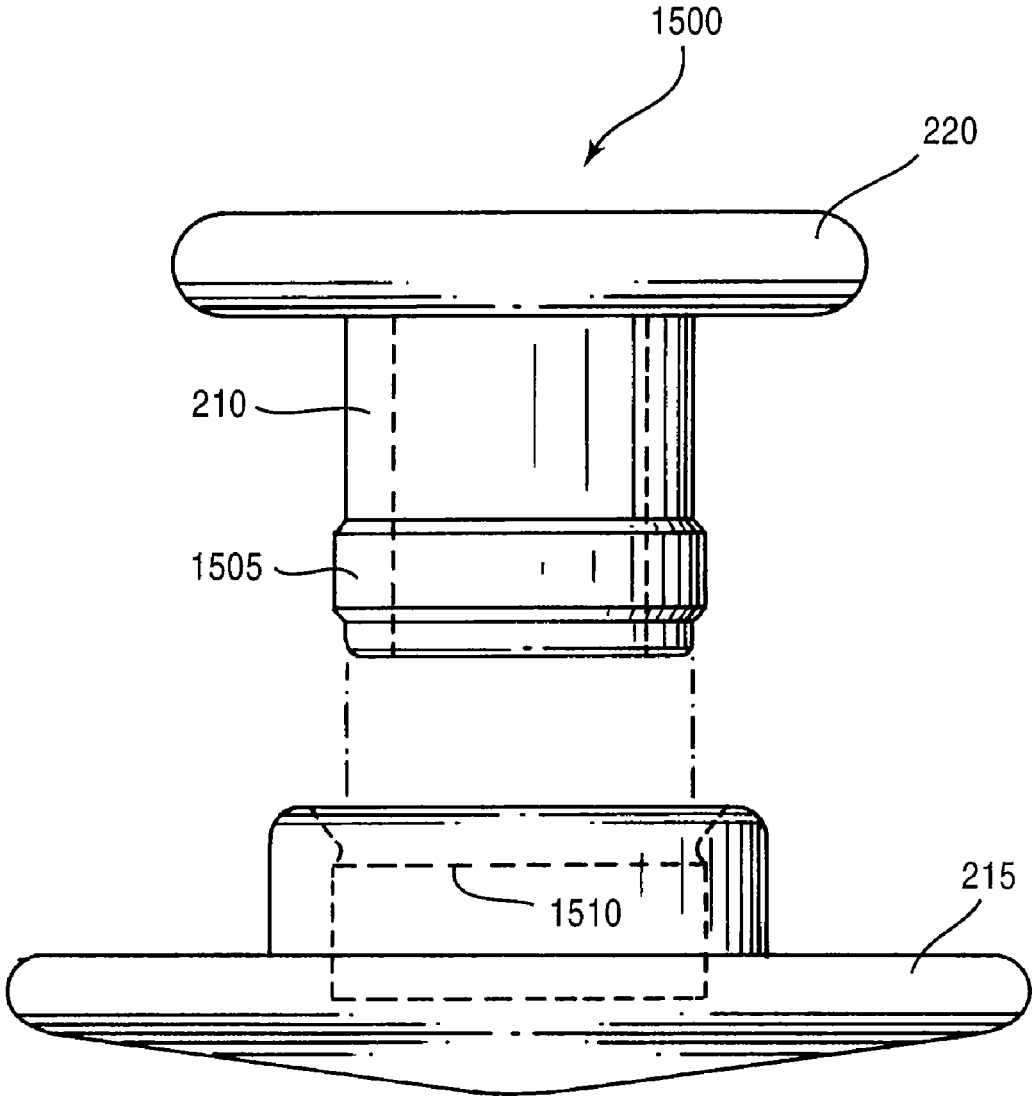
Figure 15C:
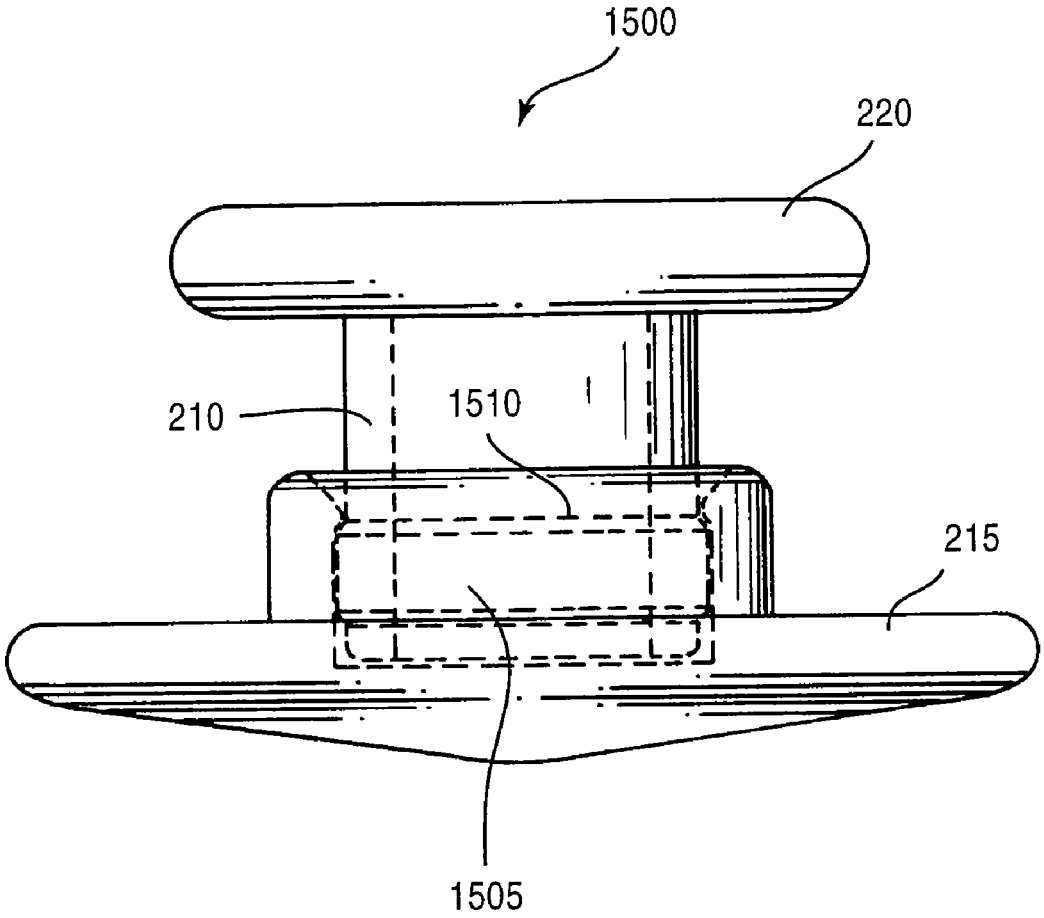

FIGS. 15A-15C illustrate a system 1500 for securing a decorative accessory 205 to a molded shoe 100 or other wearable item, in accordance with an illustrative embodiment of the invention. Referring to FIG. 15A, system 1500 includes a snap fastener different from the button snap shown in FIGS. 7A and 7B. The male portion that includes second shoulder 220 and shaft 210 is forcibly snapped into a receiving (female) portion that includes first shoulder 215. To facilitate a sufficiently tight fit, shaft 210 includes male rim 1505, and the receiving portion includes female rim 1510. FIG. 15B shows additional hidden lines to clarify the structure of system 1500. FIG. 15C shows system 1500 after the two portions of system 1500 have been fastened together.

Figures 16A, 16C, 16E, 16G:
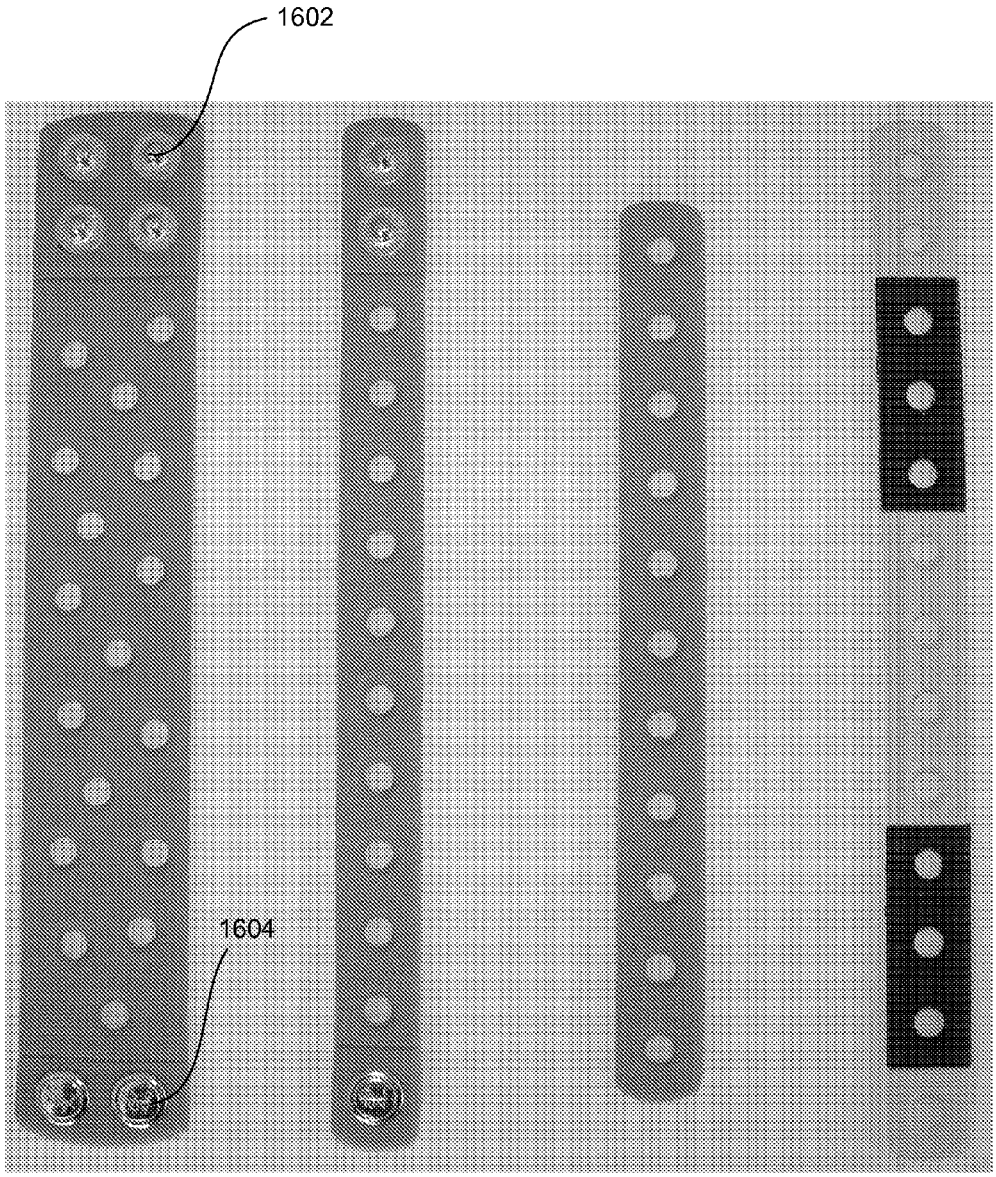
FIGS. 16A and 16B illustrate an embodiment of a wristband, according to embodiments of the present invention.
FIGS. 16C and 16D illustrate another embodiment of a wristband, according to embodiments of the present invention.
FIGS. 16E and 16F illustrate another embodiment of a wristband, according to embodiments of the present invention.
FIGS. 16G and 16H illustrate another embodiment of a wristband, according to embodiments of the present invention.
Figures 16B, 16D, 16F, 16H:
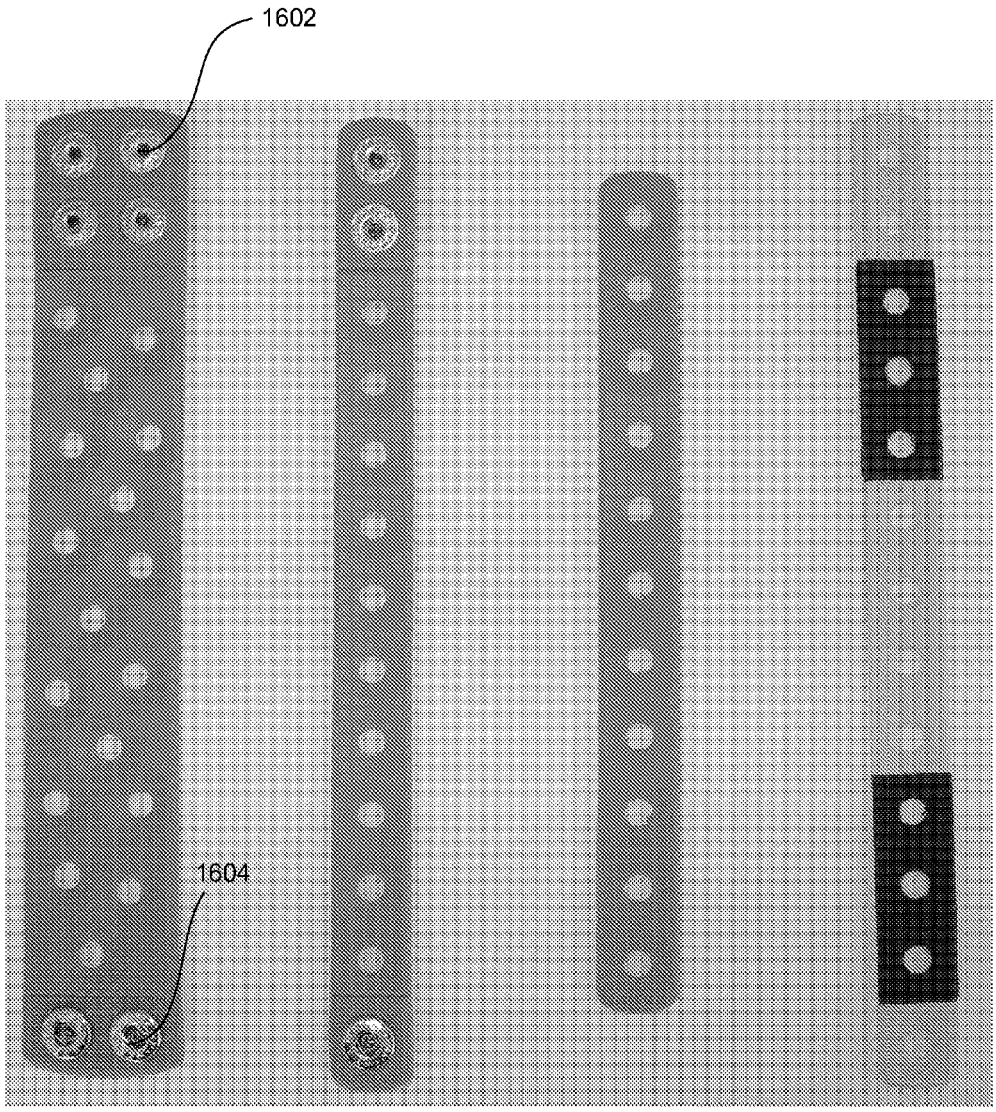

FIG. 16A shows one side of a wider style wristband made of a stretchable material. The stretchable material can be, without limitation, rubber, EVA, or PVC. The wristband in FIG. 16A has multiple expandable holes through which a securing mechanism of a removable ornament such as a Jibbitz® brand accessory or the like decorative accessory can be inserted, according to embodiments of the present invention. FIG. 16B shows the other side of the wider style wristband shown in FIG. 16A. The wristband of FIGS. 16A and 16B may be attached to itself by a snap which has a male snap component 1602 and a female snap component 1604, according to embodiments of the present invention.

FIG. 16C shows one side of a narrower style wristband made of a stretchable material. Again, the stretchable material can be, without limitation, rubber, EVA, or PVC. The wristband in FIG. 16C has multiple expandable holes through which a securing mechanism of a removable ornament such as a Jibbitz® brand accessory or like decorative accessory can be inserted, according to embodiments of the present invention. FIG. 16D shows the other side of the narrower style wristband shown in FIG. 16C. The wristband of FIGS. 16C and 16D may also be attached to itself by a snap, according to embodiments of the present invention.

FIGS. 16E, 16F, 16G, and 16H depict various types of wristbands made from a stretchable material, which do not include snaps as shown in FIGS. 16A-16D. Instead, one or more Jibbitz® brand or other decorative ornaments according to embodiments of the present invention may be used as the closure to attach or secure the wristband around the wrist of the wearer. For example, the holes of the ends of a wristband can be aligned, and then the decorative ornament can be inserted or otherwise secured through the aligned holes of both ends of the wristband to act as a closure. FIGS. 16E and 16F depict the front and back of a shorter wristband, and FIGS. 16G and 16H depict the front and back of a longer wristband, according to embodiments of the present invention.

Figure 17:
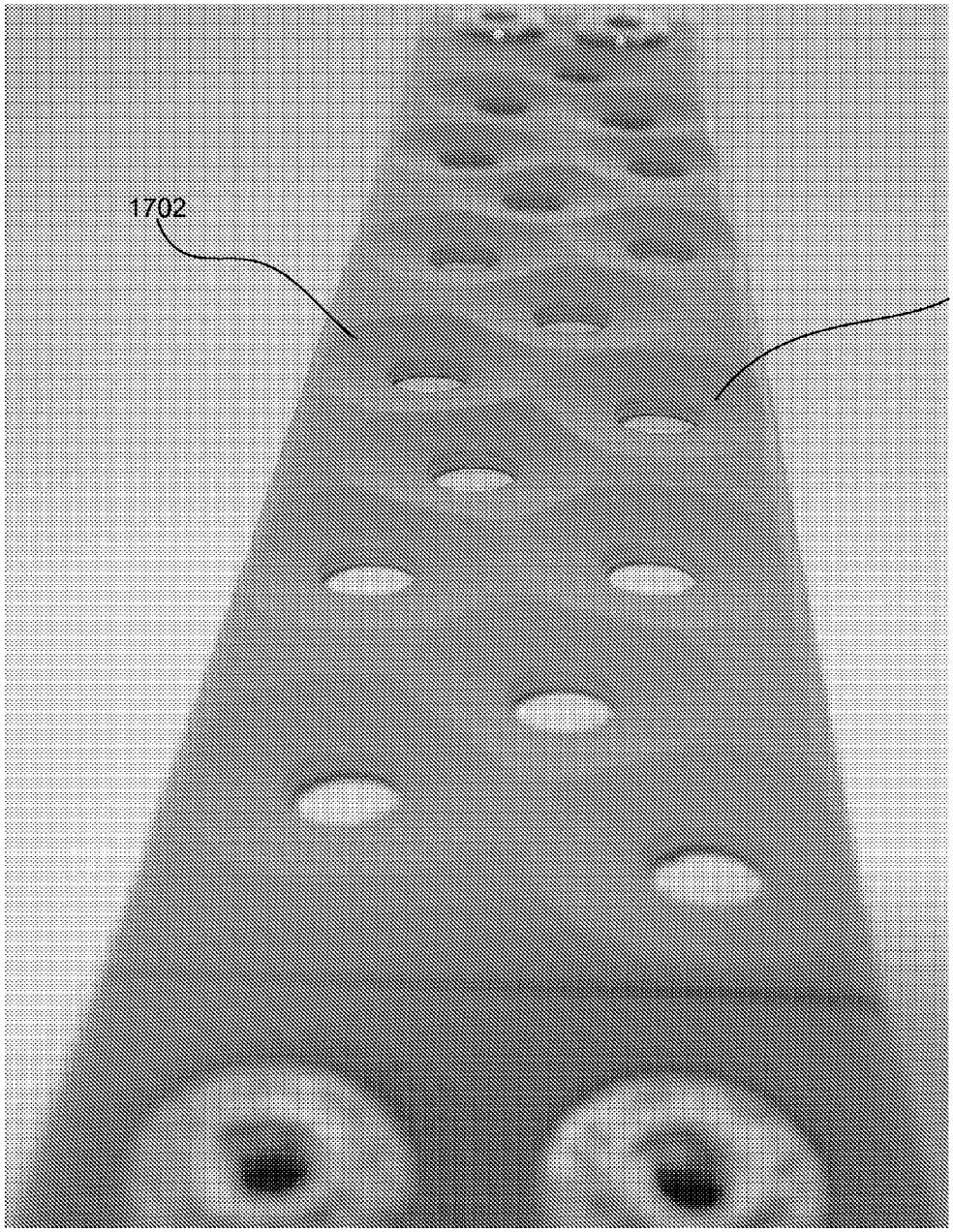
FIG. 17 illustrates indentations formed adjacent to holes on the wristband of FIGS. 16A and 16B, according to embodiments of the present invention.

FIG. 17 illustrates an enlarged perspective view of the wristband of FIGS. 16A and 16B. FIG. 17 depicts dimples or indentations 1702 surrounding the holes in the wristband. Such indentations 1702 may serve to enhance desired placement of the shoulder 215 of a decorative ornament after the shoulder 215 of the decorative ornament has been placed through the hole; alternatively, such indentations 1702 may serve to receive and guide a shoulder 215 of a decorative ornament into the hole as the shoulder 215 is being placed through the hole, according to embodiments of the present invention.

Figure 18:
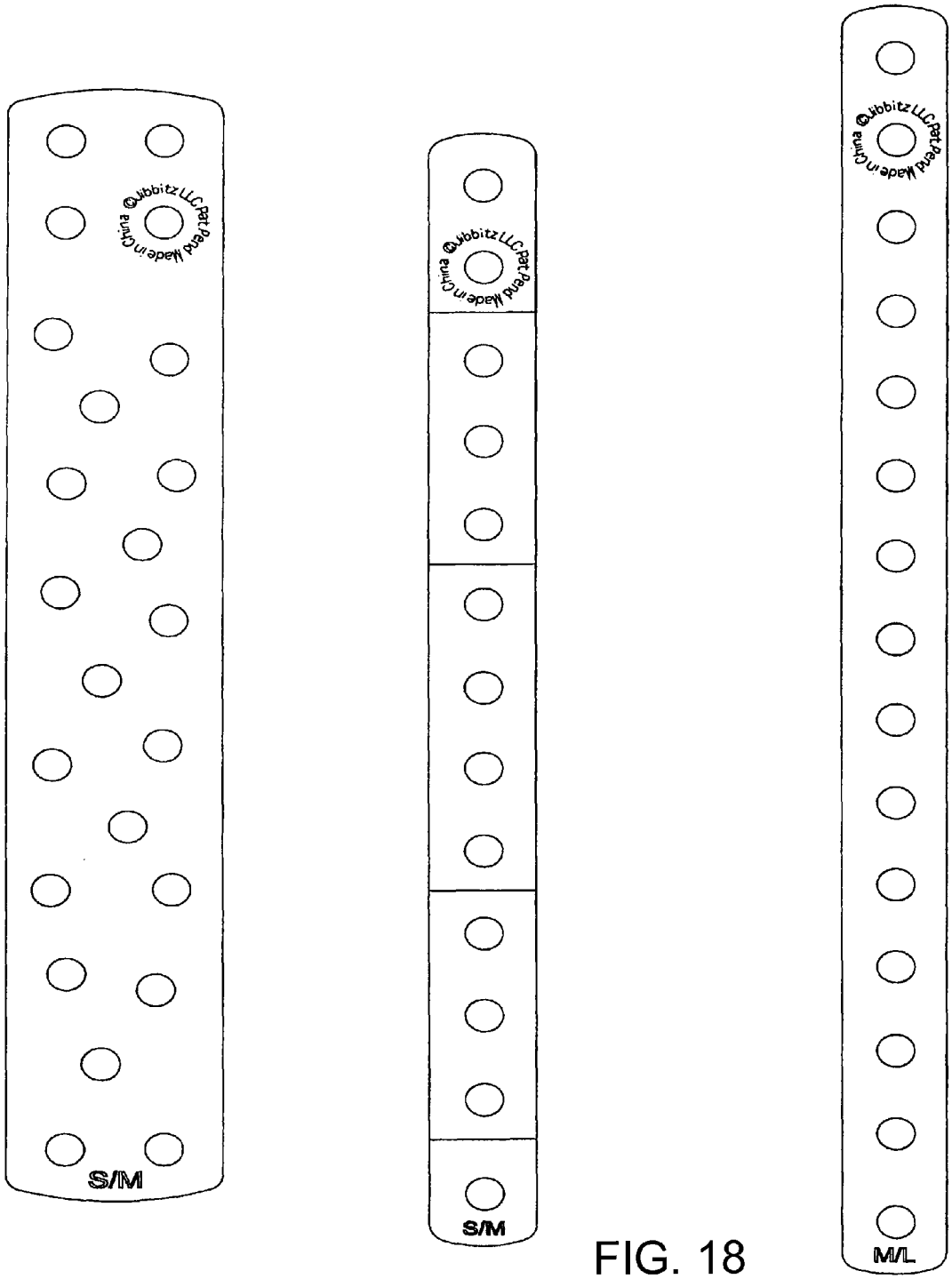
FIG. 18 illustrates various embodiments of wristbands, according to embodiments of the present invention.

FIG. 18 illustrates how information may be molded and/or imprinted on wristbands according to embodiments of the present invention. For example, patent information (e.g. "patent pending") and size information (e.g. "S/M" or "M/L") may be molded or otherwise imprinted onto a wristband made of a stretchable material, according to embodiments of the present invention. For example, the patent information may be printed in a circular fashion around a hole and/or around a snap.

Figure 19A:
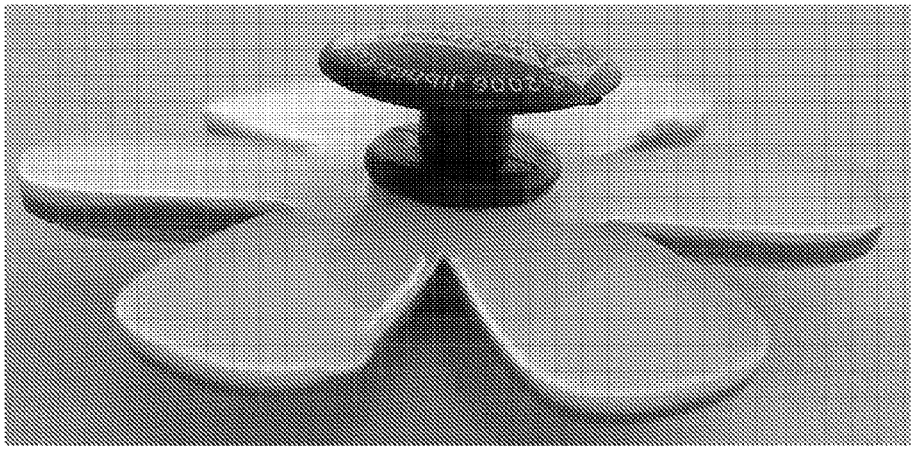
FIG. 19A illustrates an embodiment of a decorative accessory, according to embodiments of the present invention.
Figure 19B:
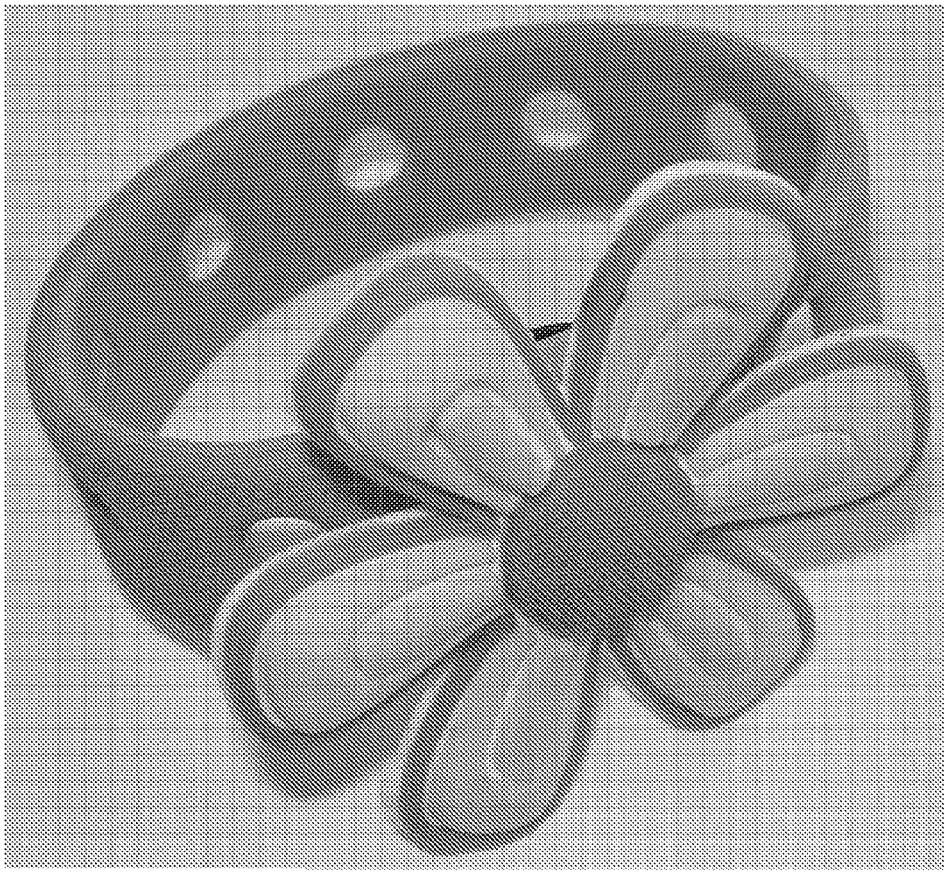
FIGS. 19B and 19C illustrate the decorative accessory of 19A used to attach the wristband of FIGS. 16E and 16F to itself, according to embodiments of the present invention.
Figure 19C:
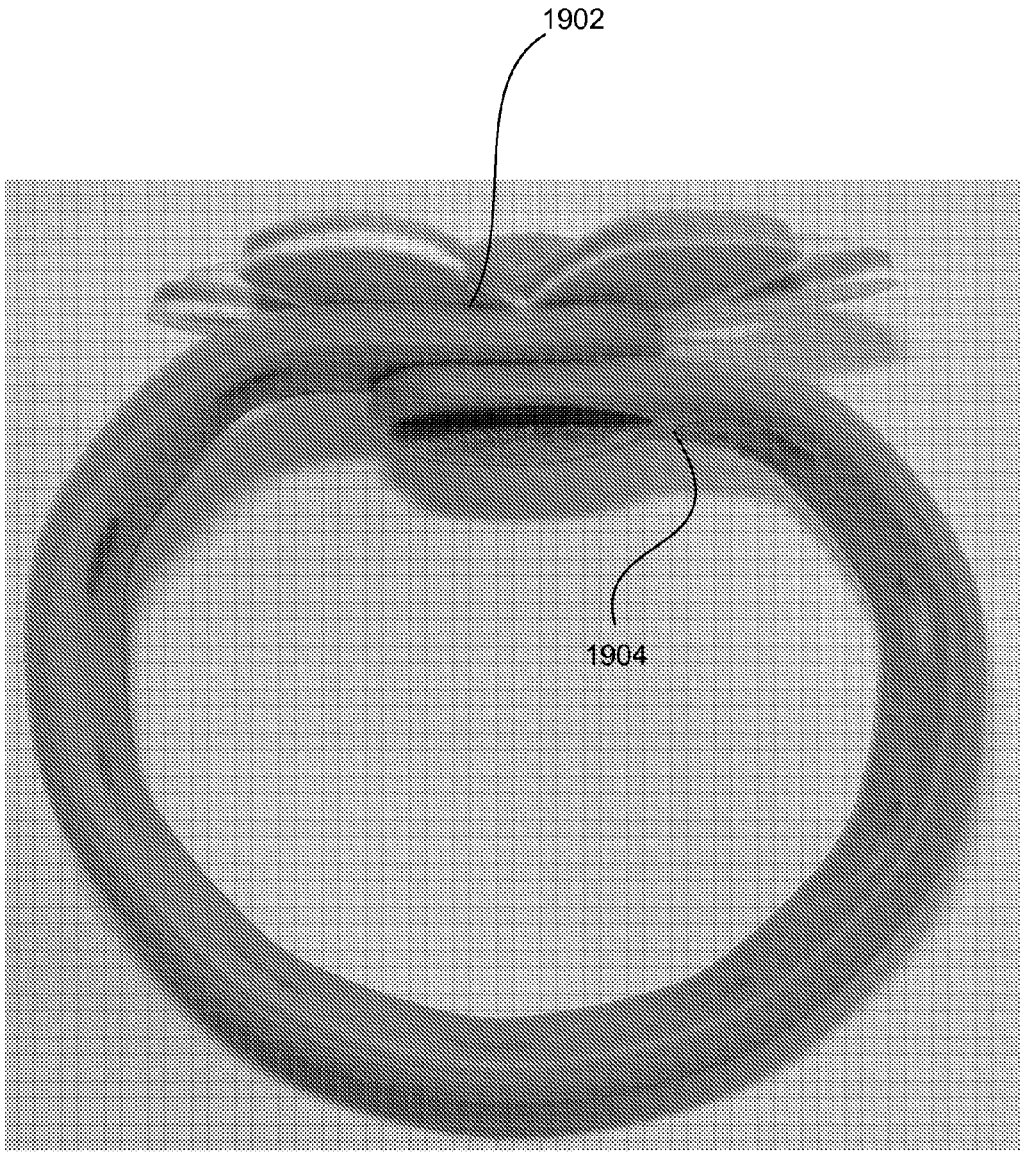

FIG. 19A illustrates an ornamental accessory according to embodiments of the present invention, and FIGS. 19B-19C illustrate the ornamental accessory of FIG. 19A applied to the wristband of FIGS. 16E-16F. Two holes in the wristband of FIGS. 16E-16F, such as, for example, two holes from different ends of the wristband, may be aligned, and then the ornamental accessory may be pushed through the expandable holes to attach the wristband onto itself After insertion through both holes, one shoulder of the ornamental accessory engages the inner surface 1904 of the wristband adjacent to the expandable hole, and another shoulder of the ornamental accessory engages the outer surface 1902 of the wristband adjacent to the other expandable hole, according to embodiments of the present invention. In this way, the ornamental accessory may act as a closure to a wristband, according to embodiments of the present invention.

Although FIGS. 16A-18 depict wristbands with certain hole placement and configurations, one of ordinary skill in the art, based on the disclosure provided herein, will recognize that various other hole placements, configurations, and numbers of holes may be employed. According to embodiments of the present invention, wearable items include, without limitation, hats, belts, shoes, bags, wristbands, clothing, or any other item which may be worn and which is made at least in part from a stretchable material having expandable holes.

In conclusion, embodiments of the present invention include, among other things, a system and method for securing accessories to shoes and other articles of clothing or wearable items. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A system for attaching a decorative accessory to a wearable item, the system comprising:

a wearable item, wherein the wearable item comprises a molded portion formed of a moldable foam material and an expandable hole formed in the molded portion;

a shaft having first and second ends;

a first shoulder secured to the first end of the shaft, the first shoulder being configured for insertion through the expandable hole in the wearable item and configured to engage an inner surface of the wearable item;

a second shoulder secured to the second end of the shaft, the second shoulder being configured to engage the wearable item; and a third shoulder adjacent to the second shoulder, the third shoulder comprising the decorative accessory.

2. The system of claim 1, wherein the first shoulder comprises a low-profile shoulder.

3. The system of claim 1, wherein the second shoulder is configured to engage an outer surface of the wearable item.

4. The system of claim 1, wherein the third shoulder is configured to engage an outer surface of the wearable item and the second shoulder is configured to fit within the expandable hole in its unexpanded state, the second shoulder providing lateral stability.

5. The system of claim 1, wherein the decorative accessory is configured to engage an outer surface of the wearable item.

6. The system of claim 1, wherein the third shoulder is flush mounted to the second shoulder.

7. The system of claim 1, wherein the third shoulder is molded around a fourth shoulder that extends from a top surface of the second shoulder.

8. The system of claim 1, wherein the third shoulder is molded around a head portion of a pin, the head portion of the pin extending from a top surface of the second shoulder, the second shoulder being molded around a needle portion of the pin.

9. The system of claim 1, wherein the shaft and at least one of the first, second, and third shoulders are integrally formed as a single piece.

10. The system of claim 1, wherein the shaft and the first, second, and third shoulders are integrally formed as a single piece.

11. The system of claim 1, wherein the first shoulder is removably secured to the shaft.

12. The system of claim 11, wherein the first shoulder comprises a snap receiver.

13. The system of claim 12, wherein the shaft includes a nipple for engaging the snap receiver.

14. The system of claim 11, wherein the first shoulder comprises a first portion of a barrel nut.

15. The system of claim 14, wherein the shaft comprises a second portion of a barrel nut configured to engage the first portion of the barrel nut, the first and second portions of the barrel nut being opposite in gender.

16. The system of claim 11, wherein the first shoulder comprises a bayonet-fastener receiver.

17. The system of claim 16, wherein the shaft includes a bayonet-fastener for engaging the bayonet-fastener receiver.

18. The system of claim 1, wherein the wearable item is a wristband.

19. A system for securing a decorative accessory to a wearable item, the system comprising:

a wearable item having an inner surface, an outer surface, and at least one stretchable hole molded with a moldable foam material;

a shaft having first and second ends;

a first shoulder secured to the first end of the shaft, the first shoulder being configured for insertion into the at least one stretchable hole in the wearable item and to engage the inner surface of the wearable item;

a second shoulder secured to the second end of the shaft, the second shoulder being configured to engage the wearable item; and a third shoulder adjacent to the second shoulder, the third shoulder comprising the decorative accessory.

20. The system of claim 19, wherein the second shoulder is configured to engage the outer surface of the wearable item.

21. The system of claim 19, wherein the third shoulder is configured to engage the outer surface of the wearable item and the second shoulder is configured to fit within the at least one stretchable hole in its relaxed state, the second shoulder providing lateral stability.

22. The system of claim 19, wherein the decorative accessory is configured to engage the outer surface of the wearable item.

23. The system of claim 19, wherein the shaft and at least one of the first, second, and third shoulders are integrally formed as a single piece.

24. The system of claim 19, wherein the shaft and the first, second, and third shoulders are integrally formed as a single piece.

25. The system of claim 19, wherein the first shoulder is removably secured to the shaft.

26. The system of claim 19, wherein the wearable item is a molded wearable item made from a stretchable material.

27. A system for securing a decorative accessory, the system comprising:

a wearable item having at least one expandable hole, the at least one expandable hole formed of a moldable foam material in a molded portion of the wearable item;

a shaft having first and second ends;

a first shoulder secured to the first end of the shaft, the first shoulder being configured for insertion through one of the at least one expandable hole and configured to engage an inner surface of the wearable item, the first shoulder being larger in diameter than the expandable hole through which it is inserted when the expandable hole is in its unexpanded state; and a second shoulder secured to the second end of the shaft, the second shoulder being configured to engage an outer surface of the wearable item, the second shoulder comprising the decorative accessory.

28. The system of claim 27, wherein at least the first shoulder and the shaft are integrally formed as a single piece of flexible material.

29. The system of claim 27, wherein the second shoulder is the decorative accessory.

* * * * *